US010107490B2

(12) United States Patent
Smith et al.

(10) Patent No.: US 10,107,490 B2
(45) Date of Patent: Oct. 23, 2018

(54) CONFIGURABLE LIQUID PRECURSOR VAPORIZER

(71) Applicant: Lam Research Corporation, Fremont, CA (US)

(72) Inventors: Colin F. Smith, Half Moon Bay, CA (US); Harald te Nijenhuis, San Jose, CA (US); Jeffrey E. Lorelli, Fremont, CA (US); Edward Sung, Sunnyvale, CA (US); Kevin Madrigal, Santa Cruz, CA (US); Shawn M. Hamilton, Boulder Creek, CA (US); Alan M. Schoepp, Ben Lomond, CA (US)

(73) Assignee: Lam Research Corporation, Fremont, CA (US)

( * ) Notice: Subject to any disclaimer, the term of this patent is extended or adjusted under 35 U.S.C. 154(b) by 204 days.

(21) Appl. No.: 14/320,371

(22) Filed: Jun. 30, 2014

(65) Prior Publication Data

US 2015/0377481 A1 Dec. 31, 2015

(51) Int. Cl.
*F22B 1/28* (2006.01)

(52) U.S. Cl.
CPC ..... *F22B 1/28* (2013.01)

(58) Field of Classification Search
CPC ..... F22B 1/28
USPC ..... 392/465–495, 386–387, 391, 399–401
See application file for complete search history.

(56) References Cited

U.S. PATENT DOCUMENTS 3,270,182 A 8/1966 Hynes
3,780,767 A 12/1973 Borg et al.
3,782,456 A * 1/1974 Gusmer ..... F28D 7/0041 165/164
3,882,934 A 5/1975 Knoos et al.
(Continued)

FOREIGN PATENT DOCUMENTS

CN 101191612 A 6/2008
DE 201210200688 7/2013
(Continued)

OTHER PUBLICATIONS

U.S. Office Action dated Aug. 9, 2017 issued in U.S. Appl. No. 14/610,990.
(Continued)

*Primary Examiner* — Ibrahime A Abraham
*Assistant Examiner* — Justin Dodson
(74) *Attorney, Agent, or Firm* — Weaver Austin Villeneuve & Sampson LLP

(57) ABSTRACT

An improved vaporizer for vaporizing a liquid precursor is provided. The vaporizer may include one or more channels with a relatively large wall-area-to-cross-sectional-flow-area ratio and may be equipped with one or more heater elements configured to heat the channels above the vaporization temperature of the precursor. At least some of the channels may be heated above the vaporization temperature but below the Leidenfrost temperature of the precursor. In some implementations, a carrier gas may be introduced at high speed in a direction generally transverse to the precursor flow to mechanically shear the precursor into droplets. Multiple
(Continued)

vaporizers may be ganged together in series to achieve complete vaporization, if necessary. The vaporizers may be easily disassembleable for cleaning and maintenance.

18 Claims, 13 Drawing Sheets

(56) References Cited

U.S. PATENT DOCUMENTS 4,358,652 A * 11/1982 Kaarup ..... H05B 6/645 219/688
4,692,592 A 9/1987 Kale
5,265,318 A 11/1993 Shero
5,356,451 A 10/1994 Cain et al.
6,409,837 B1 6/2002 Hillman
6,471,782 B1 10/2002 Feng et al.
6,912,357 B2 * 6/2005 Bissonnette ..... B05B 1/24 137/341
6,952,524 B2 10/2005 Bissonnette et al.
7,035,532 B2 4/2006 Kudo
7,190,894 B2 * 3/2007 Chamberlain, Jr. .... F24D 17/00 392/465
7,278,466 B2 10/2007 Fujisaki
7,537,047 B2 5/2009 Lai et al.
7,730,747 B2 * 6/2010 Galante ..... C03B 19/1415 118/726
7,760,993 B2 * 7/2010 You ..... D06F 39/008 392/324
7,823,543 B2 11/2010 Nomura
8,028,664 B2 10/2011 Kim
8,107,803 B1 1/2012 Hannah et al.
8,122,736 B2 2/2012 Martins et al.
8,463,117 B2 6/2013 Yeung
8,554,064 B1 * 10/2013 Dinh ..... B01D 1/08 392/386
8,666,238 B2 3/2014 Wheeler et al.
8,724,978 B2 5/2014 Furumura et al.
8,821,640 B2 9/2014 Cleary et al.
9,664,412 B2 5/2017 Sakai et al.
9,676,251 B2 6/2017 Yokoyama et al.
9,982,341 B2 5/2018 Schoepp et al.
2004/0258403 A1 12/2004 Abras et al.
2010/0092163 A1 4/2010 Yeung
2010/0296800 A1 11/2010 Min et al.
2011/0048341 A1 * 3/2011 Zhang ..... F22B 1/28 122/366
2015/0352468 A1 12/2015 Lin
2016/0222508 A1 8/2016 Schoepp et al.

FOREIGN PATENT DOCUMENTS

WO WO 2002/068713 9/2002
WO WO 2008/061405 A1 5/2008

OTHER PUBLICATIONS

U.S. Notice of Allowance dated Jan. 5, 2018 issued in U.S. Appl. No. 14/610,990.
Chinese First Office Action dated May 3, 2017 issued in Application No. CN 201510373832.2.

* cited by examiner

CONFIGURABLE LIQUID PRECURSOR VAPORIZER

BACKGROUND

Certain semiconductor manufacturing processes require precursors to be vaporized before introduction into semiconductor processing chambers. The precursors are often provided in liquid form, thus vaporizers are necessary to vaporize the liquid precursors. Conventional vaporizers often vaporize liquid precursors by spraying the precursor through an atomizer nozzle and then heating the atomized precursor in a heated carrier gas.

SUMMARY

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale unless specifically indicated as being scaled drawings.

A vaporizer for vaporizing semiconductor processing precursors is provided. The vaporizer may include one or more channels and may be equipped with one or more heater elements configured to heat the channels above the vaporization temperature of the precursor. At least some of the channels may be heated above the vaporization temperature but below the Leidenfrost temperature of the precursor. In some implementations, a carrier gas may be introduced to mechanically shear the precursor into droplets. Multiple vaporizers may be ganged together in series to achieve complete vaporization, if necessary. The vaporizers may be easily disassembleable for cleaning and maintenance.

In certain implementations, a vaporizer may be provided. The vaporizer may include a first vaporizer plate with a first side and a second side opposite the first side, one or more first channels bounded at least in part by the first side, one or more second channels bounded at least in part by the second side, a first inlet area, a first outlet area, and one or more first holes that fluidly connect the first channels with the second channels. The first vaporizer plate may be interposed between the first inlet area and first outlet area, each first channel may span between the first inlet area and one of the first holes, each second channel may span between the first outlet area and one of the first holes, each hole may fluidically connect a first channel with a second channel, each first channel may be fluidically connected with the first inlet area, and each second channel may be fluidically connected with the first outlet area.

In some such implementations of the vaporizer, the vaporizer may further include a first heating assembly that may include a first heating platen that is in thermally-conductive contact with the first side of the first vaporizer plate and a first heating element configured to heat the first heating platen. In some such implementations, the first heating element may be a heating plate in thermally-conductive contact with the first heating platen. In some further or additional implementations, the first heating platen may further include a platen inlet hole and the platen inlet hole may be fluidically connected with the first inlet area. In some further or additional implementations, the vaporizer may further include a second heating assembly that may include a second heating platen that may be in thermally-conductive contact with the second side of the first vaporizer plate and a second heating element that may be configured to heat the second heating platen, such that the first vaporizer plate is interposed between the first heating platen and the second heating platen. In some such implementations, the second heating platen may further include a platen outlet hole and the platen outlet hole may be fluidically connected with the first outlet area.

In some further or additional implementations of the vaporizer, the first vaporizer plate may be an assembly that includes a heating element between the first side and the second side.

In some further or additional implementations of the vaporizer, the vaporizer may further include one or more carrier gas injector flow channels such that each of the carrier gas injector flow channels may include a carrier gas injector flow channel first end and a carrier gas injector flow channel second end, each of the carrier gas injector flow channels may be configured to flow a carrier gas, and each of the carrier gas injector flow channel second ends may terminate in one of the first channels, one of the second channels, or one of the first holes. In some such implementations, each of the carrier gas injector channel second ends may terminate in a first hole. In some further or additional implementations, the vaporizer may further include a carrier gas injector such that the carrier gas injector may be configured to inject carrier gas into the one or more carrier gas injector flow channels.

In some further or additional implementations of the vaporizer, the vaporizer may include one or more gas injector flow channels such that each gas injector flow channel may be configured to flow gas into one of the first holes in a direction substantially normal to the first side. In some such implementations, the vaporizer may further include a gas plenum and a gas inlet such that the gas plenum may fluidically connect the gas inlet with the one or more gas injector flow channels and the gas inlet may be configured to be connected with a gas supply.

In some further or additional implementations of the vaporizer, the one or more first channels may follow substantially-linear paths from the first inlet area to the one or more first holes.

In some further or additional implementations of the vaporizer, the one or more seconds channels may follow substantially-linear paths from the one or more first holes to the first outlet area.

In some further or additional implementations of the vaporizer, the one or more first channels may follow non-linear paths from the first inlet area to the one or more first holes.

In some further or additional implementations of the vaporizer, the one or more seconds channels may follow non-linear paths from the one or more first holes to the first outlet area.

In some further or additional implementations of the vaporizer, the one or more first holes may be arranged in a radial pattern around the first inlet area. In some such implementations, the one or more first channels may follow paths that spiral outwards from the first inlet area to the one or more first holes.

In some further or additional implementations of the vaporizer, the vaporizer may further include at least two first channels, at least two second channels, and at least two first holes such that the length of each of the first channels may be equal and the length of each of the second channels may be equal.

In some further or additional implementations of the vaporizer, the vaporizer may further include a second vaporizer plate with a third side and a fourth side opposite the third side, one or more third channels bounded at least in part by the third side, one or more fourth channels bounded at least in part by the fourth side, a second inlet area, a second outlet area, and one or more second holes. The second vaporizer plate may be interposed between the second inlet area and second outlet area. Each third channel may span between the second inlet area and one of the second holes. Each fourth channel may span between the second outlet area and one of the second holes. Each second hole may fluidically connect a third channel with a fourth channel. Each third channel may be fluidically connected with the second inlet area, and each fourth channel may be fluidically connected with the second outlet area. In some such implementations, the vaporizer may further include a couple that fluidly connects the first outlet area with the second inlet area. In some such implementations, the couple may further include a couple heater element configured to deliver heat to gas, fluid, or mixtures thereof that flow through the couple.

In some further or additional implementations of the vaporizer, the vaporizer may include between 12 and 36 first channels.

In certain implementations, a vaporizer may be provided. The vaporizer may include a first vaporizer stage, including a first inlet area, a first outlet area, one or more first vaporization channels, at least one first heating element, and a controller. The controller may be configured to cause the at least one first heating element to heat the one or more first vaporization channels to a first temperature between the vaporization temperature of a first precursor and the Leidenfrost temperature of the first precursor. The one or more first vaporization channels may be internal to a first vaporizer body. The first inlet area, the first outlet area, and the one or more first vaporization channels may be configured such that fluids flowed into the first inlet area flow along the one or more first vaporization channels to the first outlet area.

In some such implementations of the vaporizer, the first vaporizer stage may further include a first vaporizer plate with a first side and a second side opposite the first side such that each first vaporization channel may include a first channel that is at least partially bounded by the first side, a second channel that is at least partially bounded by the second side, and a hole through the first vaporizer plate that fluidically connects the first channel with the second channel. In some such implementations, the vaporizer may further include one or more first carrier gas injector flow channels and one or more first carrier gas injectors such that the one or more first vaporization channels may be configured to vaporize a percentage of the first precursor in the first vaporizer stage and the one or more first carrier gas injector flow channels may be configured to flow a carrier gas injected by the one or more first carrier gas injectors into at least one of the first vaporization channels to mechanically shear a portion of the first precursor that is in a liquid state.

In some further or additional implementations, the vaporizer may further include a second vaporizer stage including a second inlet area, a second outlet area, one or more second vaporization channels, and at least one second heating element such that the one or more second vaporization channels may be internal to a second vaporizer body, the second inlet area may be fluidically connected to the first outlet area, the second inlet area, the second outlet area, and the one or more second vaporization channels may be configured such that fluids flowed into the second inlet area flow along the one or more second vaporization channels to the second outlet area, and the controller may be configured to cause the second heating element to heat the one or more second vaporization channels to a second temperature higher than the first temperature. In some such implementations, the vaporizer may further include a couple with at least one couple channel such that the at least one couple channel may be fluidically connected to the first outlet area and the second inlet area.

In some further or additional implementations, the first vaporizer stage may be configured to allow for non-destructive removal of the vaporizer plate for cleaning.

These and other aspects of the present invention are described and illustrated with reference to several embodiments herein.

BRIEF DESCRIPTION OF THE DRAWINGS

FIGS. 1A through 8B are drawn to-scale within each Figure, although the scale from Figure to Figure may differ.

DETAILED DESCRIPTION

Figure 1A:
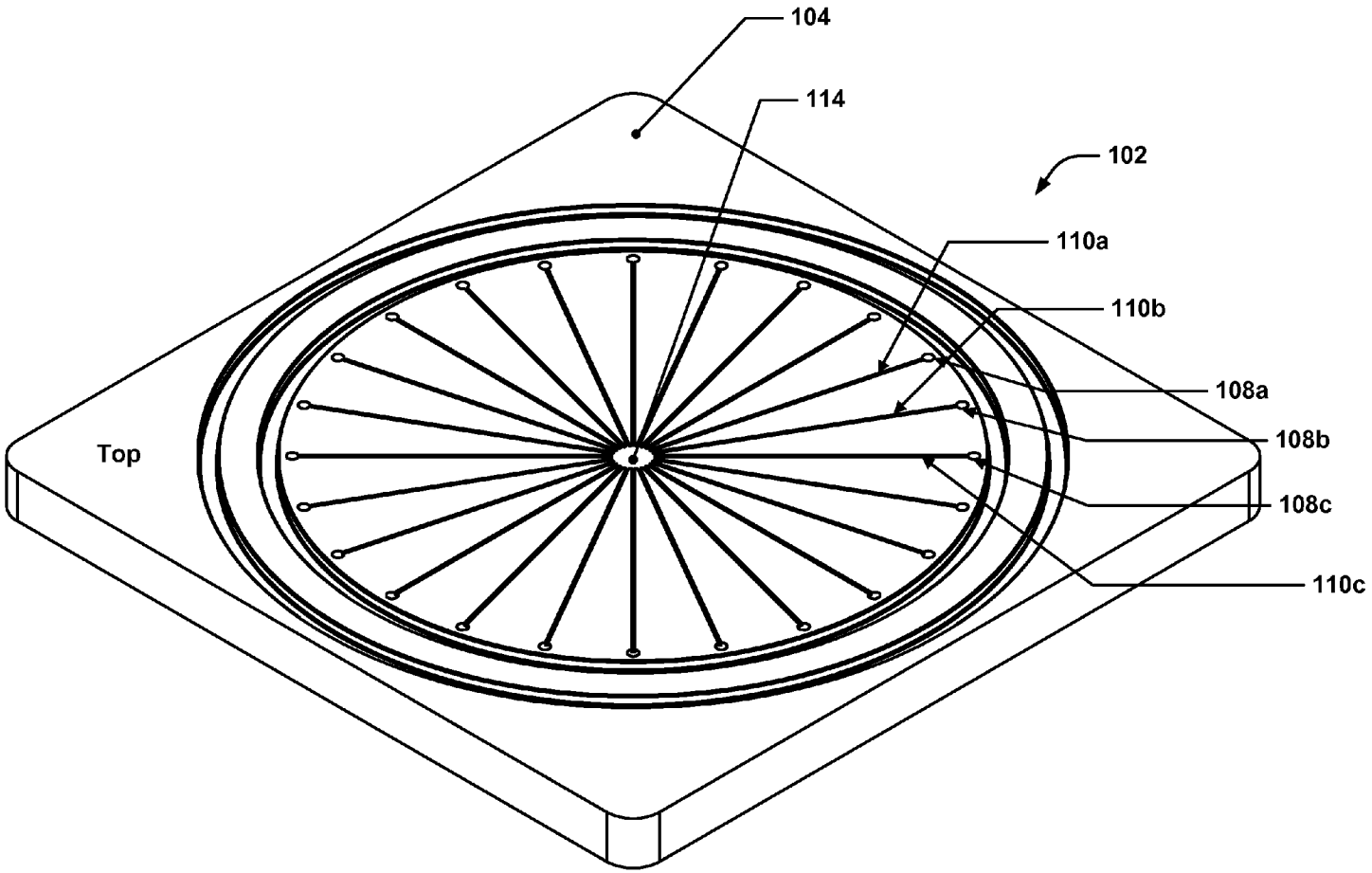
FIG. 1A is a top isometric view of an example vaporizer plate.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale unless specifically indicated as being scaled drawings.

Wafer uniformity is an important factor in the processing of high quality semiconductor wafers. In certain implementations of semiconductor processing, a liquid precursor may need to be evaporated or vaporized before being deposited on a semiconductor wafer. Complete evaporation of the precursor may have a large effect on the processing uniformity of processed semiconductor wafers. The present inventors have determined that many commercial off-the-shelf vaporizers exhibit less than complete vaporization of the precursor.

It is to be understood that, as used herein, the term "semiconductor wafer" may refer both to wafers that are made of a semiconductor material, e.g., silicon, and wafers that are made of materials that are not generally identified as semiconductors, e.g., epoxy, but that typically have semiconductor materials deposited on them during a semiconductor processing. The apparatuses and methods described in this disclosure may be used in the processing of semiconductor wafers of multiple sizes, including 200 mm, 300 mm, and 450 mm diameter semiconductor wafers.

The present inventors have realized that a vaporizer that is configured, for example, to utilize relatively long, thin flow passages that are heated to a point higher than the vaporization temperature of a liquid, but not above the Leidenfrost temperature for that liquid, may be much more effective and efficient at vaporizing the liquid than conventional vaporizer systems, e.g., vaporizers that utilize an atomizer nozzle to spray the liquid into a fine mist of droplets that are then partially or wholly evaporated by being entrained in a heated gas. The vaporizer detailed in this disclosure may be used with any precursor suitable for use in semiconductor processing, as well as liquids that are not necessarily related to semiconductor manufacturing.

As mentioned above, conventional vaporizers typically function by first atomizing the liquid to be vaporized into a mist of fine droplets that are then heated in a gaseous environment, e.g., entrained in a heated carrier gas. The theory of operation of such conventional vaporizers is that the atomization partitions the liquid into a multitude of smaller portions with a greater surface-area-to-volume ratio than existed in the precursor prior to atomization and that such an increased surface-area-to-volume ration results in relatively rapid evaporation of the remaining liquid-phase precursor in the heated carrier gas.

Due to the manner in which such conventional vaporizers work, the carrier gas must flow through the vaporizer at relatively high speeds, e.g., 300 m/s. Since the degree of evaporation is based on residence time of the atomized precursor/carrier gas in the heated environment of the vaporizer, the flow path length of the precursor/carrier gas is generally viewed to be determinative of the degree of vaporization experienced. This presents an issue since the atomized precursor/carrier gas mixture flows at a high rate of speed and thus travels through the vaporizers quickly—while residence time can be increased by extending the flow path length, vaporizer manufacturers are typically constrained by packaging constraints of semiconductor manufacturing tools, i.e., such manufacturers typically try to minimize size of the vaporizer. Most conventional vaporizers are designed such that their flow path lengths, and thus atomized precursor residence times, are sufficiently long enough to theoretically vaporize all of the atomized droplets (without being too long); due to the packaging constraints discussed above, these flow paths are usually not made any longer.

However, such designs typically rely on an average droplet size when such flow path lengths are determined. Since some droplets will be bigger and some smaller in actual practice, the smaller-size droplets will still completely evaporate, but the larger-sized droplets will frequently exit such vaporizers before completely evaporating. Having droplets exit the vaporizer before complete vaporization may lead to wafers experiencing unacceptable amounts of defects, due to such incomplete precursor vaporization on the part of a conventional vaporizer. After investigating, the present inventors determined that the conventional vaporizers, while generally advertising 100% vaporization, frequently did not, in general, offer such performance due to the above-discussed apparent reliance on an average droplet size. Moreover, the present inventors realized that the carrier gas was actually a poor heat conductor since thermal conductivity of gases is quite poor as compared to solids. The present inventors previously used techniques such as installing a porous filter in series after the vaporizer to remove many of the remaining droplets. Nonetheless, such filters were unable to completely filter out all of the remaining, unevaporated, droplets, leading to an unacceptable amount of defects. As semiconductor fabrication techniques continue to advance, the number of defects left by leftover, unevaporated droplets became a much more sensitive issue as new fabrication techniques have a lower tolerance for defects.

The present inventors decided to reexamine the fundamental design principles of vaporizers and determined that a vaporizer that flowed the precursor through one or more long, thin heated passages (rather than introducing the precursor to a heated carrier gas environment through atomization) result in more efficient heat transfer to the precursor and thus greater evaporation efficiency than is observed in most conventional vaporizers. Building on this principle, the present inventors realized further that by keeping the temperature of the flow passage walls to a point lower than the Leidenfrost temperature of the precursor (but above the vaporization temperature), the Leidenfrost effect may be avoided and more efficient evaporation obtained.

The Leidenfrost effect refers to a behavior observed in liquids that are in contact with a heated surface. As the temperature rises above the boiling or evaporation temperature, the liquid starts to evaporate—the rate of evaporation continues to increase with increasing temperature until the Leidenfrost temperature is reached. At this point, a thin layer of the liquid may evaporate such that the resulting gas is trapped between the liquid and the heated surface, forming an insulating layer in between the surface and the liquid. This causes the heat transfer rate to the liquid to drop, and lowers the evaporation rate (even though the temperature of the heated surface has continued to increase).

Thus, the present inventors have realized that by using long, relatively thin passages or channels, e.g., having a length to major cross-sectional width or depth of at least 10:1, that are heated to a point between the vaporization temperature of the precursor and the Leidenfrost point of the precursor, the precursor (or other liquid to be vaporized) may be vaporized in a much more efficient manner such that true, complete vaporization of the precursor may be achieved in the same, or smaller, overall package volume of a conventional vaporizer.

Various features of such vaporizers are discussed below with respect to various example vaporizer implementations. A vaporizer with a vaporizer plate and heated channels is described. Various implementations of the vaporizer may have multiple channels, carrier gas introduced at a point of the precursor flow-path, and/or multiple vaporizer plates. Such a vaporizer may be installed in a semiconductor processing tool and may be used to aid in the delivery of a precursor into a semiconductor processing chamber. Of course, such vaporizers may also be used in other contexts where vaporization of fluids is desired, and such vaporizers are not restricted to use in semiconductor operations. This disclosure is not to be viewed as describing vaporizers that are only used in semiconductor processing operations, and these principles may be used in a vaporizer used in any type of apparatus in which liquid vaporization is desired.

Figure 1B:
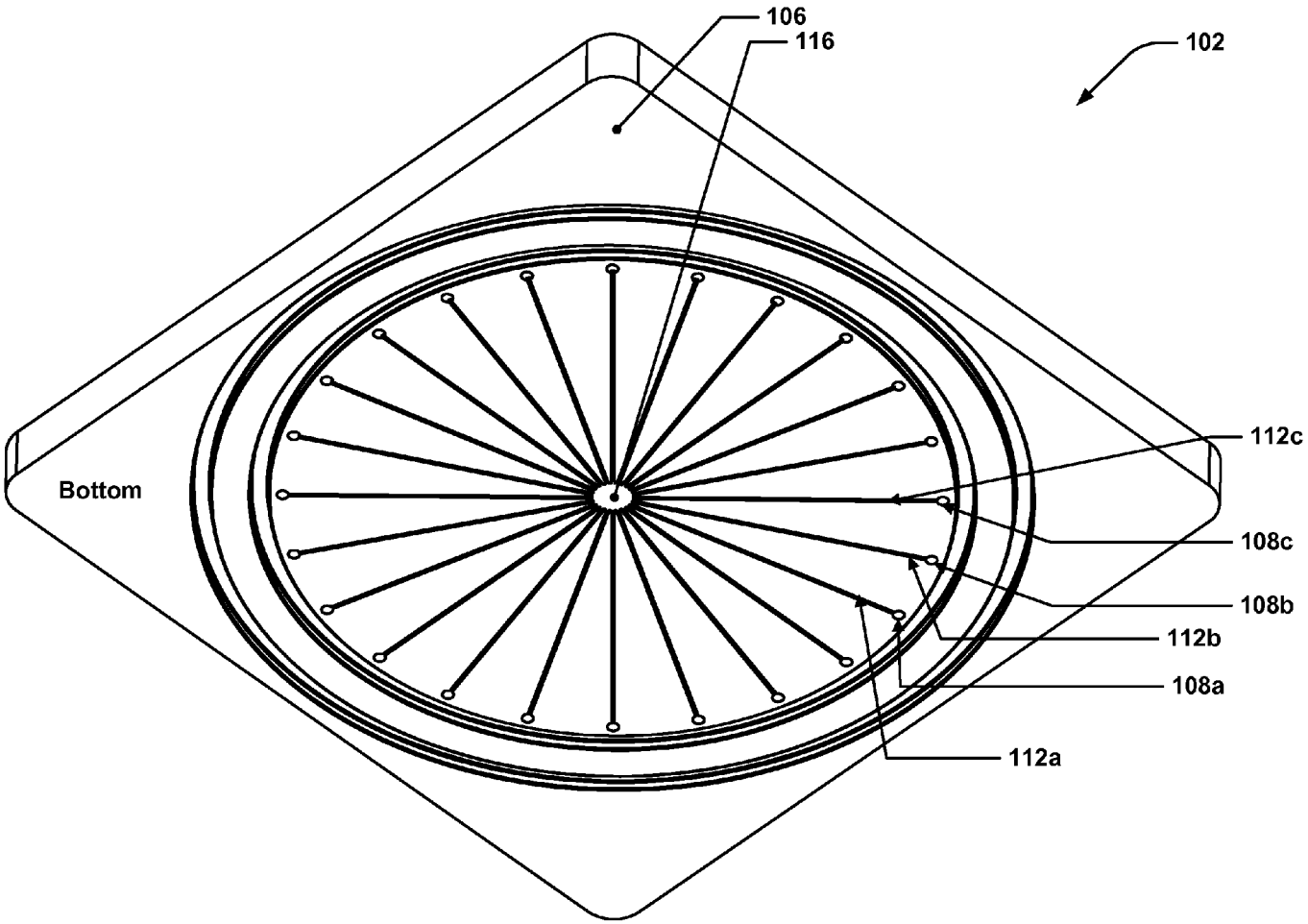
FIG. 1B is a bottom isometric view of the example vaporizer plate.

FIG. 1A is a top isometric view of an example vaporizer plate. FIG. 1A shows a first vaporizer plate 102 including a first side 104, multiple first holes (with first holes 108*a-c* annotated), multiple first channels (with first channels 110*a-c* annotated), and a first inlet area 114. The first vaporizer plate 102 also includes a second side 106 and a first outlet area 116 not shown in FIG. 1A, but shown in FIG. 1B. Also pictured are two concentric seal grooves that encircle the first channels 110, the first inlet area 114, and the first holes 108; in vaporizer implementations that may be able to be disassembled for service, such seal grooves may receive mechanical seals, e.g., metal C-seals or W-seals, that seal the first channels 110, the first inlet area 114, and the first holes 108 off from the ambient environment. Not shown in FIG. 1 are various other features, e.g., through-holes for fasteners that may be used to assemble the first vaporizer plate 102 to various other components in the vaporizer. Such through-holes may be placed outside of the outermost seal groove to avoid the need to provide additional seals for each such fastener through-hole.

The first inlet area 114 may act as a plenum designed to collect a precursor that enters the vaporizer and to then distribute the precursor to the various first channels 110. The first inlet area 114 of the first vaporizer plate 102 is circular, but other implementations of the first inlet area 114 may have geometries other than circular geometries.

Each of the first channels 110 may fluidly connect the first inlet area 114 to one of the first holes 108. During operation of the vaporizer, the first channels 110 may guide the flow of precursor from the first inlet area 114 to the various first holes 108. In operation, the walls of the first channels 110 may be heated, as is discussed in more detail below. The first channels 110 of the first vaporizer plate 102 follow linear paths that travel directly from the first inlet area 114 to the first holes 108. In other implementations, the first channels 110 may be channels having various other geometries and paths. Some alternative channel geometries are detailed later in this disclosure.

The first holes 108, including the first holes 108*a-c*, connect the first channels 110 with second channels 112 located on a second side 106 of the first vaporizer plate 102 (not shown in FIG. 1A, but shown in FIG. 1B, e.g., second channels 112*a*, 112*b*, and 112*c*). The second channels 112 may also be heated, as is discussed further below. In the first vaporizer plate 102, the first holes 108 are circular holes that span linearly from the first side 104 of the first vaporizer plate 102 to the second side. Other implementations of the vaporizer plate may have first holes 108 in various other geometries. These other geometries may include first holes 108 that are not circular, e.g., first holes that are of polygonal shapes, or first holes that do not span linearly from the first side to the second side.

FIG. 1B is a bottom isometric view of the example vaporizer plate. FIG. 1B shows the bottom view of the first vaporizer plate 102 of FIG. 1A. This view of the first vaporizer plate 102 shows the second side 106, the multiple first holes 108 (with the first holes 108*a-c* annotated), multiple second channels 112 (with second channels 112*a-c* annotated), and a first outlet area 116.

During operation of the vaporizer, the precursor may flow from the first inlet area 114 (shown in FIG. 1A) and into the first channels (also shown in FIG. 1A). The precursor may be flowed through the first channels 110 and into the first holes 108. The precursor may then flow from the first side 104 to the second side 106 via the first holes 108. After flowing from the first side 104 to the second side 106, the precursor may then flow through the second channels 112 to the first outlet area 116. The first outlet area 116 is a plenum designed to collect the precursor flow from the second channels so that the precursor may be flowed to another part of the vaporizer or to a location downstream from the vaporizer.

Figure 2:
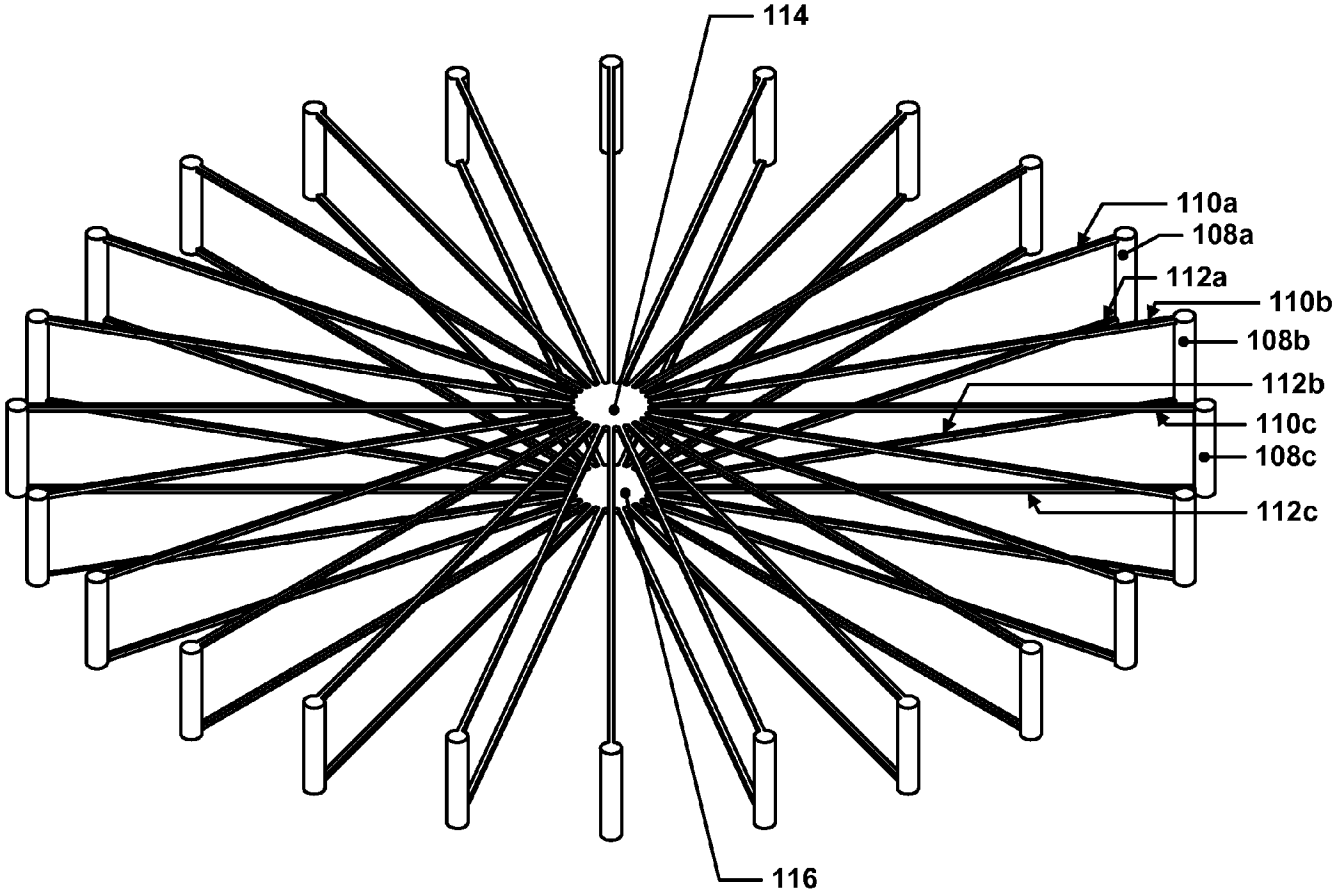
FIG. 2 is a schematic representation of the channel and hole volumes of the vaporizer plate within which the precursor flows for the example vaporizer of FIGS. 1A and 1B.

FIG. 2 is a schematic representation of the channel and hole volumes of the vaporizer plate within which the precursor flows for the example vaporizer of FIGS. 1A and 1B. The representation in FIG. 2 includes the first inlet area 114, multiple first channels 110 (with first channels 110*a-c* annotated), multiple first holes 108 (with first holes 108*a-c* annotated), multiple second channels 112 (with second channels 112*a-c* annotated), and the first outlet area 116.

For clarity, the body/solid material of the first vaporizer plate 102 is not shown in FIG. 2. Instead only the "negative space" that defines the flow-paths or volumes that the precursor may flow through is shown. As discussed with respect to FIGS. 1A and 1B, the precursor in FIG. 2 may be distributed by the first inlet area 114 to the various first channels 110 and flow from the various first channels 110 of the first side 104 to the various second channels 112 of the second side 106 via the various first holes 108 (such as the first holes 108*a-c*), and flow from various second channels 112 to the first outlet area 116. Since the first vaporizer plate 102 has a symmetrical geometry in regards to the first channels 110, first holes 108, and second channels 112, the various first channels 110, as well as the various first holes 108 and the various second channels 112, may have similar flow rates and flow volumes of precursor in this example. However, other implementations may not feature such radially-symmetric flow paths, and such implementations may feature one or more flow paths having different geometries, path configurations, etc., which may provide for differing flow rates and/or volumes of precursor along each channel. Radial symmetry was used in this example for various reasons, including simplification of analysis and manufacture.

While the implementation of the first vaporizer plate 102 shown in FIGS. 1A, 1B, and 2 includes first channels 110 and second channels 112, other implementations of the vaporizer plate may include only first channels 110 and first holes 108. Such an implementation may be used for vaporizing precursors that are easily vaporized, i.e., that may be fully vaporized by the time they reach the second side 106, and do not require additional flow through the second channels 112 for further vaporization. In such a configuration, the various first holes may directly outlet the precursor from the vaporizer plate into, for example, a process chamber, or the first outlet area may be expanded (in a manner similar to the first channel of the counterbore vaporizer discussed later in this disclosure) such that the vaporized precursor flows directly from the first holes 108 to the first outlet area 116.

Figure 3A:
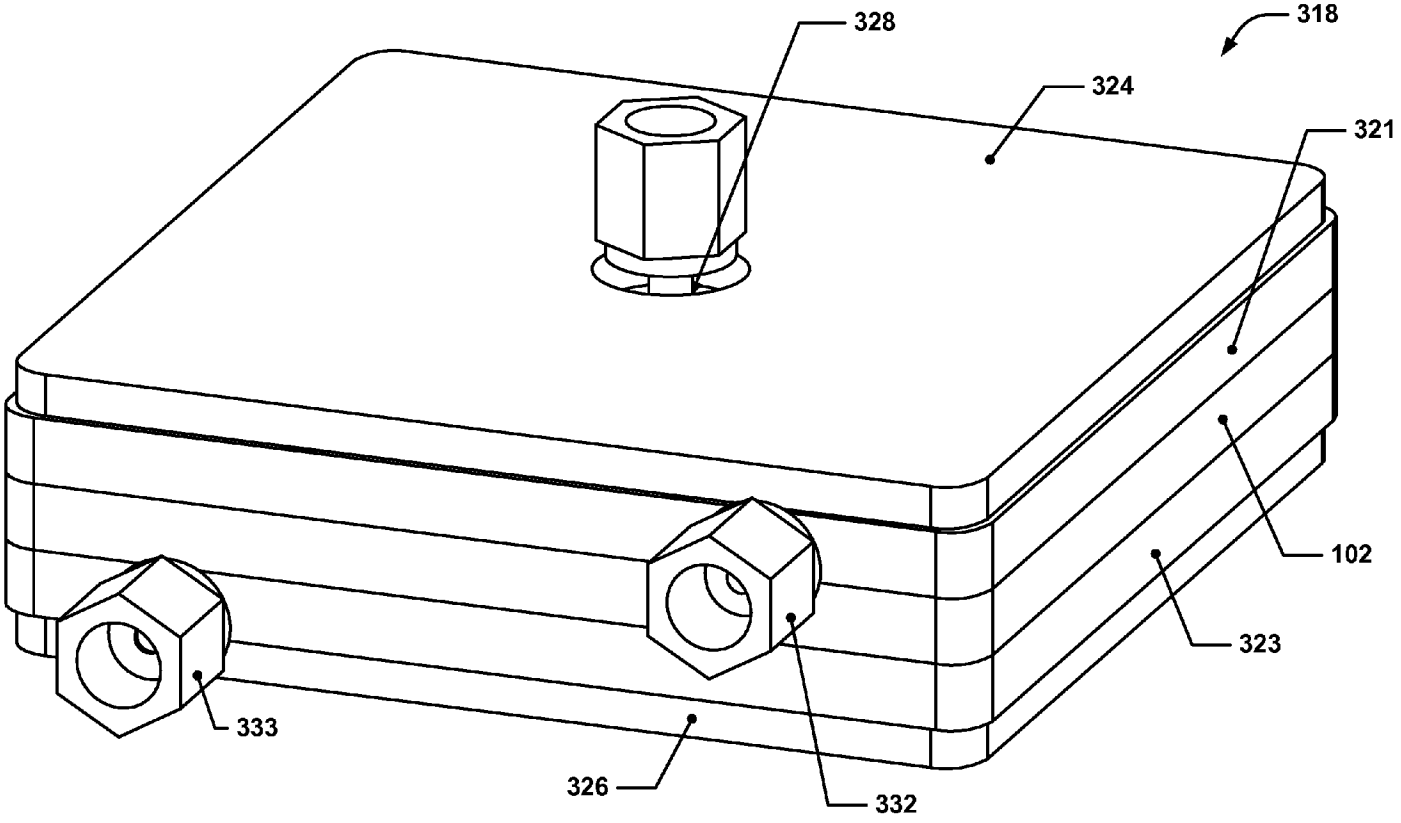
FIG. 3A shows an example vaporizer with a vaporizer plate and two heating platens.
Figure 3B:
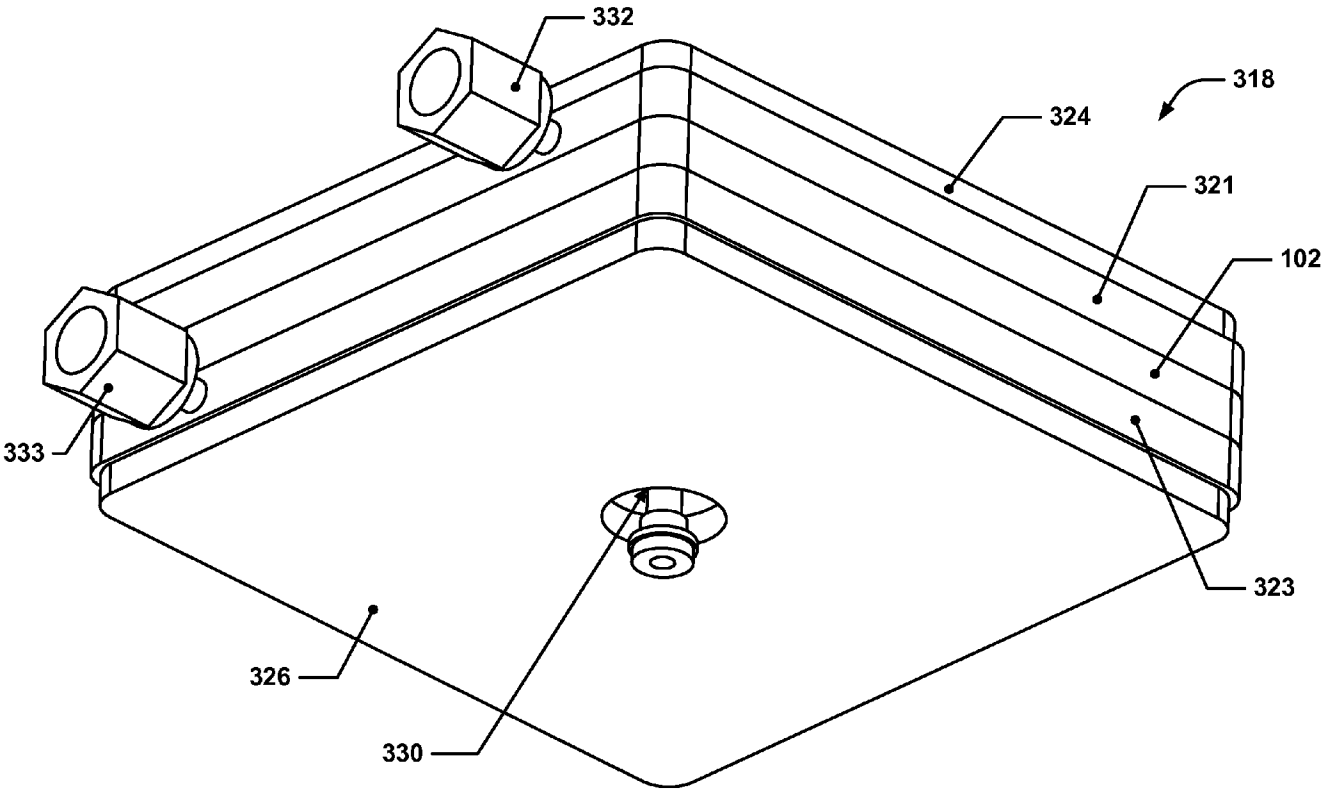
FIG. 3B shows another view of the example vaporizer with the vaporizer plate and two heating platens.

The first vaporizer plate 102 of FIG. 1A is part of a vaporizer that may also include heating platens. FIG. 3A shows an example vaporizer with a vaporizer plate and two heating platens. As discussed above, the first vaporizer plate 102 may be heated such that the first channels 110 and the second channels 112 are heated to a point between the vaporization temperature of the precursor and the Leidenfrost temperature of the precursor. FIG. 3A shows a view of the top of vaporizer 318. Vaporizer 318 may include the first vaporizer plate 102, a first heating platen 321, a first heating element 324, a second heating platen 323, a second heating element 326, a platen inlet 328, a carrier gas port 332, and a vacuum port 333. Vaporizer 318 may also include platen outlet 330 which is not shown in FIG. 3A, but is shown in FIG. 3B.

The first vaporizer plate 102 is similar to the vaporizer plate described previously for FIGS. 1A, 1B, and 2. The first heating platen 321 may be assembled to the first side of the first vaporizer plate 102 and, when assembled with the first heating element 324, may be used to heat the first channels of the first vaporizer plate 102 during operation of the vaporizer 318. The first heating platen 321 may be assembled to the first vaporizer plate 102 in a variety of ways, including being attached with fasteners such as clips, rivets, and/or screws, or through adhesives and/or other hardware (not shown).

In the implementation of the vaporizer 318 shown in FIG. 3A, the first heating platen 321 may be combined with the first heating element 324 to form a first heater assembly. The first heating element 324 may be a heating element such as an electric heating plate, hot plate, heating coils, or other device configured to conductively distribute heat through the heating platen 321 and across the first vaporizer plate 102. In the implementation shown in FIG. 3A, the first heating element 324 conductively heats the first heating platen 321, raising the temperature of the first heating platen 321, which then conductively heats the first vaporizer plate 102. In additional or alternative implementations, the first heating element may be internal to the first heating platen or may be integral to the first heating platen rather than part of a separate component attached to an exterior surface of the heating platen. In other implementations, the first heating element may be internal to the first vaporizer plate. In such implementations, the vaporizer may not include heating platens and may instead have first heating element conductively heat the channels of the first vaporizer plate.

In the implementation of the vaporizer shown in FIG. 1A, the first channels are rectangular in cross-section and, when the vaporizer is assembled, the first heating platen 321 defines one side of the rectangular cross-section of the first channels. The other three sides of the rectangular cross-section of the first channels are defined by features of the first vaporizer plate 102. Other implementations of the vaporizer may have the first channels fully contained within the vaporizer plate, or have more than one side of the first channels defined by the first heating element, e.g., the first channels 110 may be grooves in the heating platen 321 and the first vaporizer plate 102 may be flat, or both the heating platen 321 and the first vaporizer plate 102 may have matching or complementary grooves in them. In some implementations, the first vaporizer plate 102 and the heating platen 321 may be brazed or otherwise semi-permanently bonded together. The implementation shown, however, is readily disassemble able, allowing the vaporizer to easily be taken apart for maintenance and cleaning. The first channels may also have different cross-sections such as circular, polygonal, or triangular cross-sections.

The second heating platen 323 may be assembled to the second side of the first vaporizer plate 102 and may be used to heat the second channels 112 of the first vaporizer plate 102 during operation of the vaporizer 318 in much the same way that the first heating platen 321 is used to heat the first channels 110. The second heating platen 323 may be assembled to the first vaporizer plate 102 in the same variety of ways that the first heating platen 321 may be assembled to the first vaporizer plate 102. The second heating element 326 may also be similar in configuration and geometry to the first heating element 324.

The second heating element 326 may heat the second channels 112 located on the second side 106 of the first vaporizer plate 102 in a manner similar to the manner the first heating element 322 heats the first channels 110, i.e., the second heating element 326 heating the second heating platen 323 which then conducts heat to the second channels 112. The second channels 112 are also defined in the same manner that the first channels 110 are defined.

In some implementations, vaporization may be further assisted by introducing a carrier gas across the flow path of the precursor in a manner that causes the precursor to be mechanically sheared by the carrier gas flow. This may further assist in vaporizing the precursor. To this end, the carrier gas port 332 may be used to introduce carrier gas to the precursor flow path during operation of the vaporizer 318. In the implementation shown, carrier gas may be flowed into the carrier gas port 332. The carrier gas may then flow through a carrier gas manifold, e.g., such as the annular channel 650 depicted in FIG. 6 (discussed in further detail below), in the first heating platen 320 and may then be directed into the first holes via corresponding gas nozzles so as to mechanically shear, and mix with, the precursor. The vacuum port 333 may be used to apply a vacuum to a vacuum region between the two concentric seal grooves. This may a) ensure that the precursor is not contaminated by ambient air that may leak past the seals and b) that the precursor does not leak past the seals into the ambient environment (which may be dangerous, as such precursors are often toxic). The concentric seal grooves and vacuum region are described in greater detail in FIG. 5. A differential pressure sealing system may not be necessary or used in every implementation; if not, then the vacuum port 333 and related features may be omitted.

The precursor may be introduced to the first inlet area via the platen inlet 328, which may be fluidly connected with the first inlet area 114 of the first vaporizer plate 102. In FIG. 3A, the platen inlet 328 takes the form of a tube and fitting that may be attached to a precursor source. The precursor may enter the platen inlet 328 and then flow into the first inlet area 114 before being distributed to the various first channels 110.

FIG. 3B shows another view of the example vaporizer with the first vaporizer plate 102 and the two heating platens 321 and 323. FIG. 3B shows a view of the bottom of the vaporizer 318 shown in FIG. 3A. In addition to the components of the vaporizer 318 shown in FIG. 3A, FIG. 3B also shows the platen outlet 330 of the vaporizer 318.

The platen outlet 330 may be a fluid pathway that is connected to the first outlet area 116 of the first vaporizer plate 102. In FIG. 3B, the platen outlet 330 also includes a fitting that may be attached, for example, to a gas distribution showerhead or gas injector in a semiconductor processing tool. The precursor may exit the vaporizer 318 through the platen outlet 330 and may either be partially or completely gaseous upon exiting the platen outlet 330.

Figure 4:
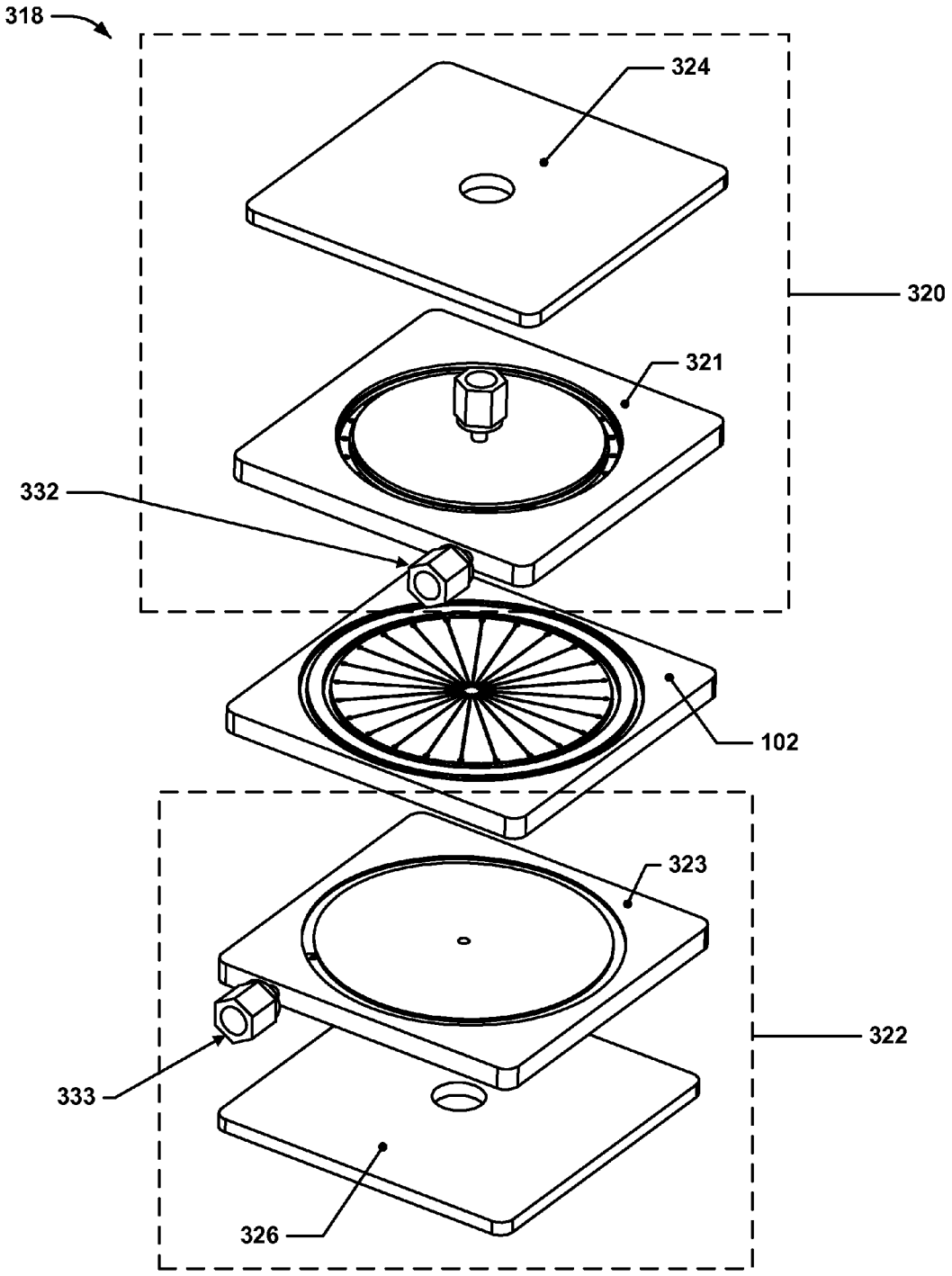
FIG. 4 is an exploded view of the example vaporizer with the vaporizer plate and two heating platens.

FIG. 4 is an exploded view of the example vaporizer with the vaporizer plate and two heating platens. FIG. 4 shows an exploded view of the vaporizer 318 from FIGS. 3A and 3B. Vaporizer 318 includes the first vaporizer plate 102, the first heating assembly 320 (including the first heating platen 321 and the first heating element 324), the second heating assembly 322 (including the second heating platen 323 and the second heating element 326), the carrier gas port 332, and the vacuum port 333.

The first vaporizer plate 102, the first heating platen 321, the second heating platen 323, the first heating element 324, the second heating element 326, the carrier gas port 332, and the vacuum port 333 are similar to the respective components described previously. The exploded view of FIG. 4 shows that the first heating assembly 320 and the second heating assembly 322 have separate heating platens and heating elements. Having heating elements separate from the heating platens may be advantageous in many ways, including allowing different heating elements to be combined with the heating platens based on the heating needs of the vaporizer configuration, allowing for easy repair and servicing, and allowing for off-the-shelf components to be used. The heating platens may be assembled with the separate heating elements through the use of fasteners, adhesives, welding, brazing, and other attachment methods. Other implementations may have the heating elements as integral parts of the heating platens, in which case the heating assemblies may not be easily disassembleable.

As shown in FIG. 4, the vaporizer 318 includes a stack of plate-like components. The heating elements may be mounted to the heating platens to form the heating assemblies, such as the first heating assembly 320 and the second heating assembly 322. The first vaporizer plate 102, the first heating assembly 320, and the second heating assembly 322 may be assembled such that the first vaporizer plate 102 is between the first heating platen 321 and the second heating platen 323 with the first heating platen 321 interfacing with the first side of the first vaporizer plate 102 and the second heating platen 323 interfacing with the second side of the first vaporizer plate 102. The first vaporizer plate 102 may be assembled with the first heating assembly 320 and the second heating assembly 322 through the use of fasteners, adhesives, and/or other attachment methods (again, features such as fastener holes are not depicted in these examples, but such features may be placed as needed so as to hold the vaporizer together in a secure manner).

The vaporizer 318 may be disassembled into component parts. For example, the first vaporizer plate 102 may be non-destructively removed from the vaporizer 318. The first channels and second channels of the first vaporizer plate 102 may thus be exposed when the first vaporizer plate 102 is disassembled and are thus easily accessible for cleaning. As precursors tend to leave deposits in semiconductor processing components over time, the ability to non-destructively remove the first vaporizer plate 102 may allow easier cleaning of the first vaporizer plate 102 to remove these deposits than is possible in conventional vaporizers that route the precursor through an atomizer nozzle (the atomizer nozzle may not be easy to clean since there is typically no access to the precursor flow path along the length of the precursor flow path).

Figure 5:
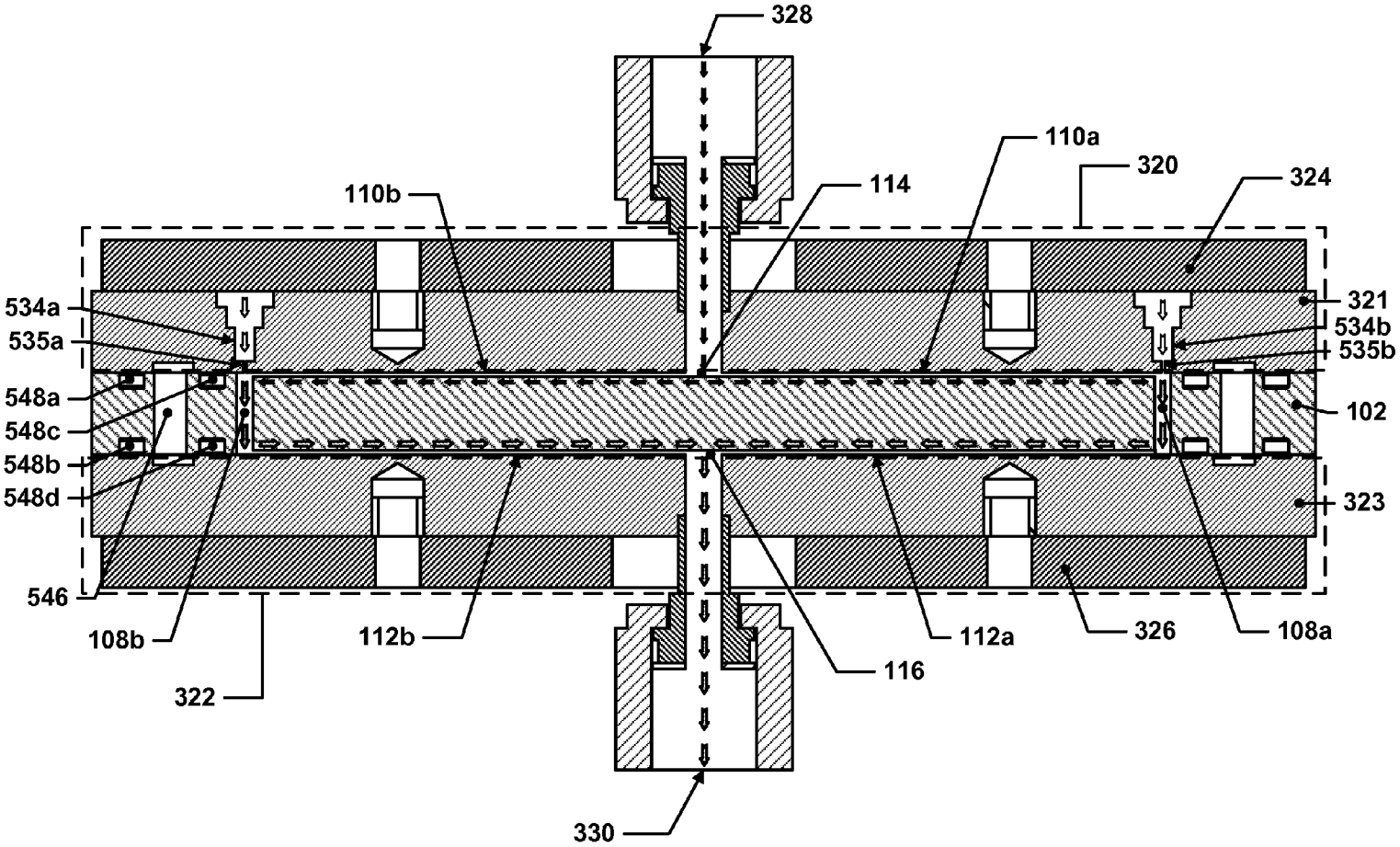
FIG. 5 is a schematic representation of carrier gas and precursor flow-paths of an example vaporizer.

FIG. 5 is a schematic representation of carrier gas and precursor flow-paths of an example vaporizer. FIG. 5 is a simplified cutaway representation of the vaporizer 318. FIG. 5 shows the first vaporizer plate 102, the first heating assembly 320 with the first heating platen 321 and the first heating element 324, the second heating assembly 322 with the second heating platen 323 and the second heating element 326, the platen inlet 328, and the platen outlet 330. The small, black arrows represent the flow of the precursor. The white arrows represent the flow of the carrier gas. The large gray arrows represent the flow of a mixture of the precursor and the carrier gas.

The first vaporizer plate 102 includes the first channels 110*a* and 110*b*, the first holes 108*a* and 108*b*, the second channels 112*a* and 112*b*, the first inlet area 114, and the first outlet area 116. The configuration of the first vaporizer plate 102 in FIG. 5 is similar to the configurations of the vaporizer plates that have previously been discussed.

The precursor may first flow through the platen inlet 328, which is similar in configuration to the platen inlets described previously, and into the first inlet area 114. The precursor may then be distributed into the first channels 110*a* and 110*b* (as well as other first channels not shown). The first channels 110*a* and 110*b* may be heated by the first heating platen 321. The first heating platen 321 may be heated by the first heating element 324 similar to the manner previously described. The first vaporizer plate 102 may be conductively heated to a temperature above the vaporization temperature of the precursor by the first heating platen 320. The heated walls of the first channels may then heat the precursor and vaporize at least a portion of the precursor. In certain implementations, the first channels may be heated to a temperature above the boiling point of the precursor, but below the Leidenfrost temperature of the precursor.

In certain implementations, the precursor may not be fully vaporized in the first channels. Instead, a portion of the precursor may continue to flow into the first holes 108*a* and 108*b* as a liquid. The precursor in the liquid state may be in the form of liquid droplets or as a continuous stream of liquid with gaseous precursor bubbles entrained within. When the precursor flows through the first holes 108*a* and 108*b*, carrier gas may be introduced to shear the droplets of the liquid precursors into smaller droplets.

The carrier gas may be introduced through the carrier gas nozzles 535*a* and 535*b*. The carrier gas nozzles 535*a* and 535*b*, through the geometry of the nozzles, may direct the flow of carrier gas into the first holes 108 and 108*b* so as to shear the precursor into droplets (or smaller droplets if the precursor is already in droplet form). The geometry of the nozzles may vary according to the requirements of the specific implementation. Factors that may influence how the carrier gas is injected into the first holes and thus the nozzle geometry include the configuration of the vaporizer plate, the anticipated size of the droplets of the precursor, the flow rate of the precursor, the flow rate of the carrier gas, the lengths of the first and second channels, the precursor used, the properties of the carrier gas, the amount of heating from the heating assemblies, etc. The carrier gas nozzles 535*a* and 535*b* may inject carrier gas into the flow path of the precursor at an angle sufficient to shear droplets of the precursor into smaller size droplets such as at a 90 degree or substantially 90 degree angle to the nominal precursor flow path. The carrier gas may be injected at other angles, such as an angle between 45 to 90degrees to the nominal precursor flow path, so long as the precursor droplets are sheared to smaller-size droplets by the carrier gas. Introduction of the carrier gas to the precursor may also lead to a lower partial pressure of the carrier gas and precursor mixture compared to the partial pressure of just the precursor, further aiding in the vaporization of the precursor.

The carrier gas flows through the vaporizer to the carrier gas nozzles 535*a* and 535*b* via the injector flow channels 534*a* and 534*b*. The injector flow channels 534*a* and 534*b* may be attached to a carrier gas injector and/or a carrier gas source not shown in FIG. 5.

The implementation of FIG. 5 introduces carrier gas to the precursor at the "elbow" where the first channels 110*a* and 110*b* meet the first holes 108*a* and 108*b*, respectively. In other implementations, carrier gas may be introduced in other areas at the holes or, perhaps, away from the holes such as in the first channels and second channels. Introduction of the carrier gas such that the carrier gas jet flows past a sharp or relatively sharp edge such as that formed at the intersection of the first channels 110*a* and 110*b* and the first holes 108*a* and 108*b* may assist in shearing the droplets to a greater extent. For example, the edge may act as a shear surface against which the droplets may be impacted and thus caused to further atomize. The carrier gas may, in general, exit the carrier gas nozzles along a direction that is nominally perpendicular or oblique to the direction of flow of the precursor just prior to the introduction of the carrier gas.

By introducing the carrier gas in the manner described above, the carrier gas may be used to, in effect, atomize the precursor. However, unlike conventional vaporizers that direct the precursor through an atomizer nozzle, the precursor does not need to pass through the carrier gas nozzles in these implementations. This reduces the potential for clogging of the carrier gas nozzles, which is a frequent problem that is encountered when precursors are directed through atomizer nozzles.

After the carrier gas has been introduced to the precursor and has sheared the precursor droplets to smaller sizes, a mixture of the precursor and carrier gas may then flow down the first holes 108*a* and 108*b* and into the second channels 112*a* and 112*b*. The precursor and carrier gas mixture may then flow along the second channels 112*a* and 112*b* to the first outlet area 116. The second channels 112*a* and 112*b* may be heated by the second heating platen 323 in the same manner as the first channels 110*a* and 110*b* are heated by the first heating platen 321.

The carrier gas and precursor mixture may exit the vaporizer by flowing from the first outlet area 116 to the platen outlet 330. The platen outlet 330 may be similar in configuration to the platen outlets previously described.

FIG. 5 also depicts a vacuum region 546 and seal grooves 548*a-d* on the left hand side of the vaporizer. The right hand side of the vaporizer includes a vacuum region and seal grooves as well, but the vacuum region and the seal grooves on the right hand side are not separately annotated in FIG. 5. The seal grooves 548*a-d* may contain a seal or seals such as O-rings, C-seals, or W-seals. The vacuum region 546 may be fluidically connected to a vacuum port (not shown in FIG. 5). During operation, the vacuum port may evacuate the vacuum region 546 to create a vacuum in the vacuum region 546. During operation of the vaporizer, the vacuum in the vacuum region 546 may draw the seals within the seal grooves 548*a-d* to be pressed against a wall of the seal grooves to help form a seal. The seal may prevent precursor from leaking into the ambient environment or for air from the ambient environment to contaminate the precursor. If any ambient air or precursor does leak past the seals, the vacuum may draw such contaminants away before they leak past all of the seals.

Figure 6:
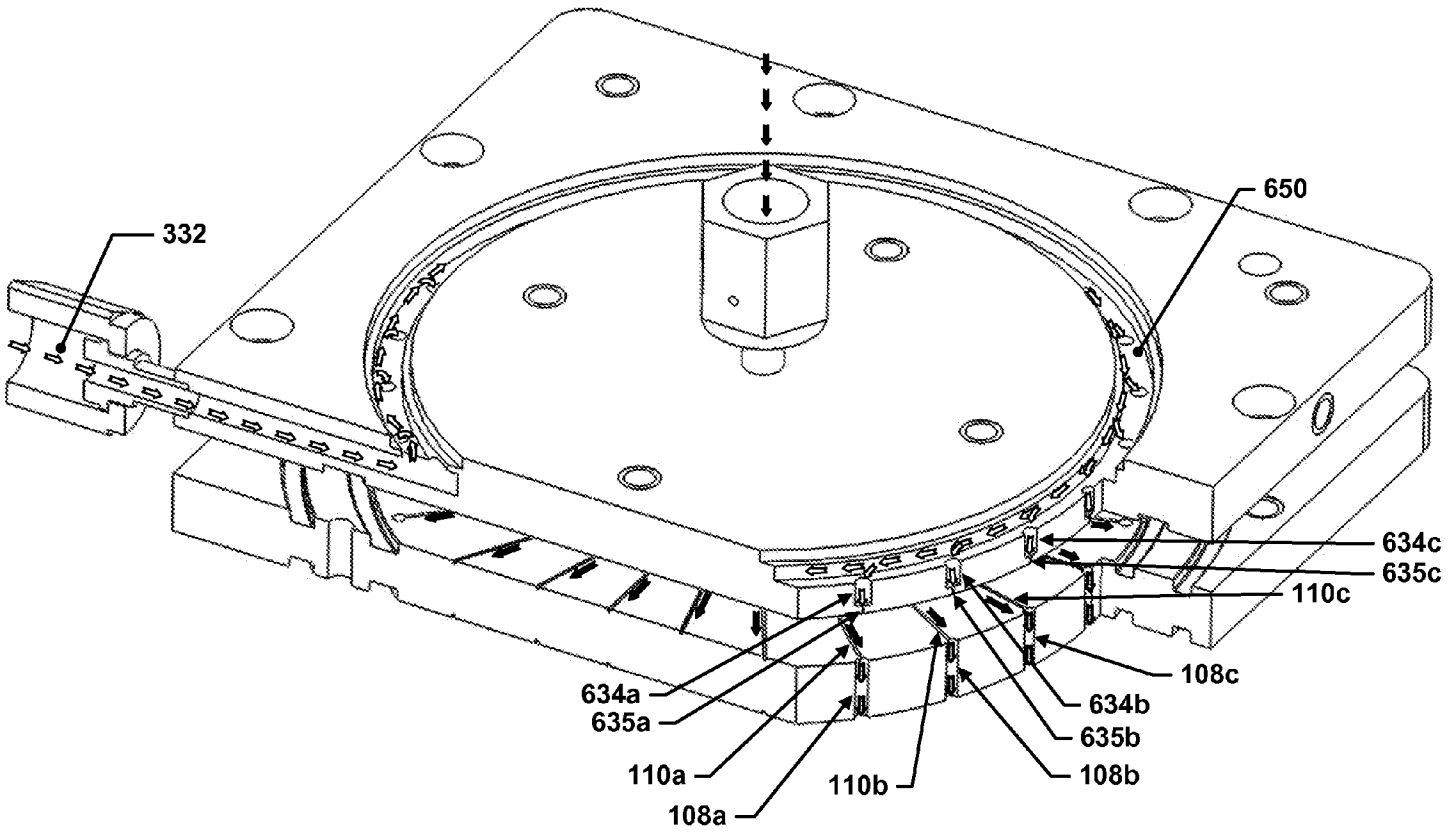
FIG. 6 is a cutaway and exploded view of an example vaporizer with a vaporizer plate and a heating platen to show a carrier gas flow path.

FIG. 6 is a cutaway and exploded view of an example vaporizer with a vaporizer plate and a heating platen to show a carrier gas flow path. FIG. 6 shows an example path that the carrier gas may travel inside a vaporizer. The arrows in FIG. 6 represent a portion of the flow-path of the carrier gas.

In FIG. 6, the carrier gas enters through the carrier gas port 332. The carrier gas port 332 may be attached to a source of carrier gas. The carrier gas may be injected at a high pressure so that the flow rate of carrier gas is high. Higher flow rates of carrier gas may aid in the shearing of the precursor droplets. Typically, the carrier gas may be supplied at a pressure that is sufficiently high that carrier gas flow from the carrier gas nozzles into the first holes is under choked flow conditions.

The carrier gas may flow into an annular channel 650 that functions as a plenum or manifold to distribute the carrier gas through the various carrier gas injector flow channels, annotated by carrier gas injector flow channels 634*a-c*. In the implementation shown in FIG. 6, the transition between the linear channel and the annular channel 650 is a small rectangular opening. Other implementations may have transitions between the linear and annular channels that are less obstructive from a flow perspective, may eliminate either the linear and/or annular channels altogether, or may have configurations where the flow of the carrier gas is not choked by the geometry of the carrier injector gas flow channels.

The carrier gas (white arrows) may be distributed by the annular channel 650 to the various carrier gas injector flow channels 634*a-c* and then be introduced into the various first holes 108*a-c* via the carrier gas nozzles 635*a-c*. The various carrier gas nozzles 635*a-c* are respectively positioned so as to direct carrier gas nominally along the center axis of the various first holes in the implementation shown in FIG. 6. The carrier gas may flow through the various gas nozzles and into the various first holes, where the carrier gas shears the droplets of the precursor (radial flow of the precursor along the first channels is shown by black arrows) into smaller droplets. The mixed carrier gas/precursor may then flow through the first holes 108 (grey arrows).

Other implementations of the vaporizer may have carrier gas distribution systems with different configurations. For example, the carrier gas nozzles may have alternative geometries and such distribution systems may incorporate other features such as additional plenums or plenums of different shapes.

To give some sense of relative scale of the vaporizer 118, various features of vaporizer 118 are described below in further detail, including various dimensional values. Such dimensional values are not to be understood as being limiting, and various other dimensional values may be used depending on the particular precursor being vaporized, the heating capacity of the heaters, the number of channels, etc. The detail provided below is simply provided as being representative of but one example.

For example, each of the 24 first channels 110 and the 24 second channels 112 may have cross-sectional areas (normal to the long axis) of ~0.26 $mm^2$ and may each be ~10 cm long. The 24 carrier gas nozzles that inject carrier gas into each of the first holes may each have minimum cross-sectional areas (perpendicular to carrier gas flow) of ~0.1 $mm^2$. It is to be understood that the number of channels used may vary depending on the particular implementation—while 24 channels are used in this example, other numbers of channels may also be used, as conditions warrant.

During operation, liquid precursor (which, in this particular case, is approximated using water) may be flowed into the first channels 110 at a rate of ~0.035 L/minute (in aggregate) and the carrier gas may be flowed into the first holes 108 (via the gas injector nozzles) at a much faster rate of 3 L/minute (in aggregate). In general, precursors with higher thermal capacities will require channels with longer lengths and/or greater channel surface areas. The flow rate of the precursor and/or carrier gas may also be varied to increase or decrease residence time within the channel(s). In certain implementations, the cross-sectional area, the length of the channels, and the flow rate may be designed to induce turbulence in the flow of the precursor to induce better mixing and better spread of heating.

In some implementations, the vaporizer plate may include thermal isolation or thermally-resistant features between the first side and the second side, thus introducing a thermal flow restriction point within the vaporizer plate that inhibits heat flow from the first side to the second side of the vaporizer plate (and vice-versa). This may allow the first channels and the second channels of a vaporizer plate to be kept at substantially different temperatures despite the fact that both sets of channels are in fluidic communication with one another and are separate by a relatively small distance within the vaporizer plate. For example, such isolation features may allow the first channels to be kept at 80° C. and the second channels to be kept at 120° C., i.e., a temperature difference of ~40° C. through the thickness of the vaporizer plate. Such thermal isolation/thermally-resistant features may include, for example, a series of holes that are drilled through width of the vaporizer plate with the hole axes parallel to one another and to the first side/second side of the vaporizer plate (such holes may be drilled, for example, using a gun drill). Such holes may be drilled such that they do not intersect with any part of the flow paths within the vaporizer plate (so as to avoid leakage of the precursor and carrier gases). If desired, additional cross-holes may be added in other directions, e.g., orthogonal to the initial cross-holes, to remove further material from the vaporizer plate. The cross-holes, by removing material from the vaporizer plate, introduce air pockets (or other discontinuities) that have a much higher thermal resistance than the material of the vaporizer plate, thus reducing heat flow through the vaporizer plate. Of course, other methods for introducing thermally-resistant features may be used as well, e.g., casting the vaporizer plate such that it has void spaces inside, making the vaporizer plate out of two pieces that, when bonded, e.g., brazed, together, form void spaces between them, etc. Such temperature differences may also be practiced between separate vaporizer stages within a vaporizer assembly, as is discussed in more detail below.

Figure 7:
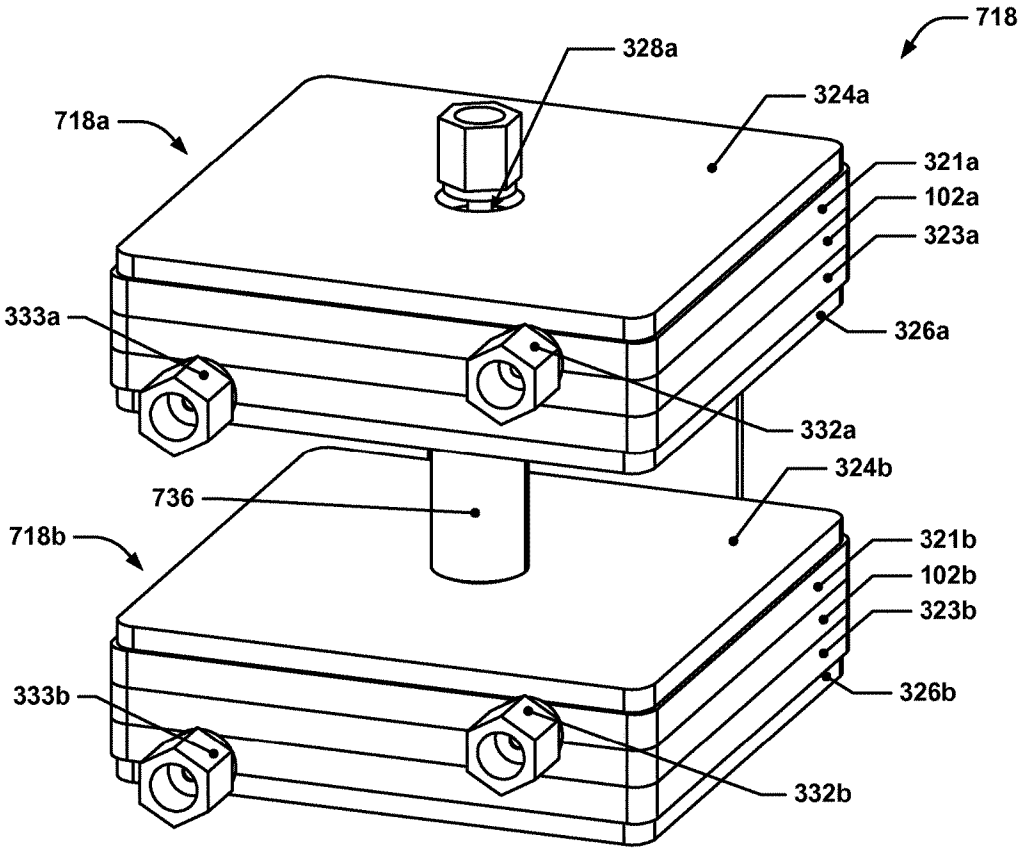
FIG. 7 shows another example multistage vaporizer with two vaporizer plates and four heating platens.

FIG. 7 shows another example vaporizer with two vaporizer plates and four heating platens. The vaporizer 718 in FIG. 7 includes a first vaporizer assembly 718*a* and a second vaporizer assembly 718*b*. The first vaporizer assembly 718*a* may include the first vaporizer plate 102*a*, a first heating platen 321*a*, a first heating element 324*a*, a second heating platen 323*a*, a second heating element 326*a*, a carrier gas port 332*a*, a vacuum port 333*a*, and a platen inlet 328*a*. The second vaporizer assembly 718*b* may include a second vaporizer plate 102*b*, a third heating platen 321*b*, a third heating element 324*b*, a fourth heating platen 323*b*, a fourth heating element 326*b*, a carrier gas port 332*b*, and a vacuum port 333*b*. The first vaporizer assembly 718*a* and the second vaporizer assembly 718*b* may be fluidly connected via a couple 736. The second vaporizer plate 102*b* may include various third channels, various second holes, and various fourth channels that are not shown in FIG. 7, but are similar to the various first channels, the various first holes, and the various second channels, respectively, that have been previously described with respect to a vaporizer according to the present disclosure.

The vaporizer 718 is a multi-stage vaporizer that is a combination of two of the vaporizers 318 shown in FIGS. 3A and 3B. The two vaporizer assemblies 718*a* and 718*b* in FIG. 7 may be thought of as two vaporizer stages and are connected by the couple 736. In certain implementations of the vaporizer 718, certain components of the first vaporizer assembly 718*a* may be heated to a temperature above the boiling point, but below the Leidenfrost temperature of the precursor. In such implementations, certain components of the second vaporizer assembly 718*b* may be heated to a temperature much higher than the temperature that the first vaporizer assembly is heated to, such as a temperature between 30 to 300° C. higher than the temperature that the first vaporizer assembly is heated to. In certain implementations, the channels of the first vaporizer assembly may be heated to 80° C. while the channels of the second vaporizer assembly may be heated to 120° C. In certain implementations, the second vaporizer assembly 718*b* may be heated to a temperature 80° C. higher than the temperature that the first vaporizer assembly 718*a* is heated to (this may result in the second stage vaporizer being heated to a temperature above the Leidenfrost temperature, although the first stage may still be heated to a temperature below the Leidenfrost temperature). In certain such implementations, carrier gas may be introduced via carrier gas ports 332*a* to shear the droplets of the precursor to a smaller size before the mixture of the precursor and the carrier gas enters the second vaporizer assembly 718*b*.

The couple 736 may provide a flow path that allows for flow of the precursor or a mixture of the precursor and the carrier gas from the first outlet area of the first vaporizer plate 102*a* to a second inlet area of the second vaporizer plate 102*b* through a channel or various channels internal to the couple body. In certain implementations, the couple 736 may also be heated. The couple 736 may, for example, be as simple as a short length of tubing that fluidly connects the platen outlet 330*a* (not shown, but corresponding to the platen outlet 330 in FIG. 3B with respect to the vaporizer 718*a*) with the platen inlet 328*b* (not shown, but corresponding to the platen inlet 328 in FIG. 3A with respect to the vaporizer 718*a*). Such a short length of tubing may be insulated to prevent cooling (and thus condensation) of the carrier gas/precursor mixture or may be heated using, for example, a resistive heating blanket or other heater (to further assist in evaporation). In the implementation of the vaporizer 718 shown in FIG. 7, the couple 736 is heated via a heater sleeve located around the couple 736, but other implementations may include unheated couples or may heat the couple through other means.

Various implementations of the vaporizer may introduce carrier gas to the precursor at various stages. For example, in some implementations of the vaporizer 718, the carrier gas may be introduced in the vaporizer stage 718*b* but not in the vaporizer stage 718*a*. In such a configuration, the precursor may be allowed to evaporate due to the application of heat at a temperature above the vaporization temperature and below the Leidenfrost temperature of the precursor throughout the entire vaporizer stage 718*a* before being subjected the mechanical shearing through the introduction of the carrier gas in the second vaporizer stage 718*b*. In other configurations, the carrier gas may be introduced in the first vaporizer stage 718*a*, and further carrier gas may not be introduced into the second vaporizer stage 718*b*. In yet other implementations, carrier gas may be introduced in both vaporizer stages 718*a* and 718*b*. If needed, additional vaporizer stages may be added in sequence to the dual-stage implementation shown, and each may be configured so as to allow for tailored introduction of carrier gas, e.g., some stages may introduce carrier gas, others may not. The vaporizer 718 is configurable to deliver carrier gas at any of the aforementioned locations and in certain configurations may deliver carrier gas at none, some, or all of the aforementioned locations. Each stage may also be heated to different temperatures, as may be needed depending on the vaporization requirements and the precursor.

Figure 8A:
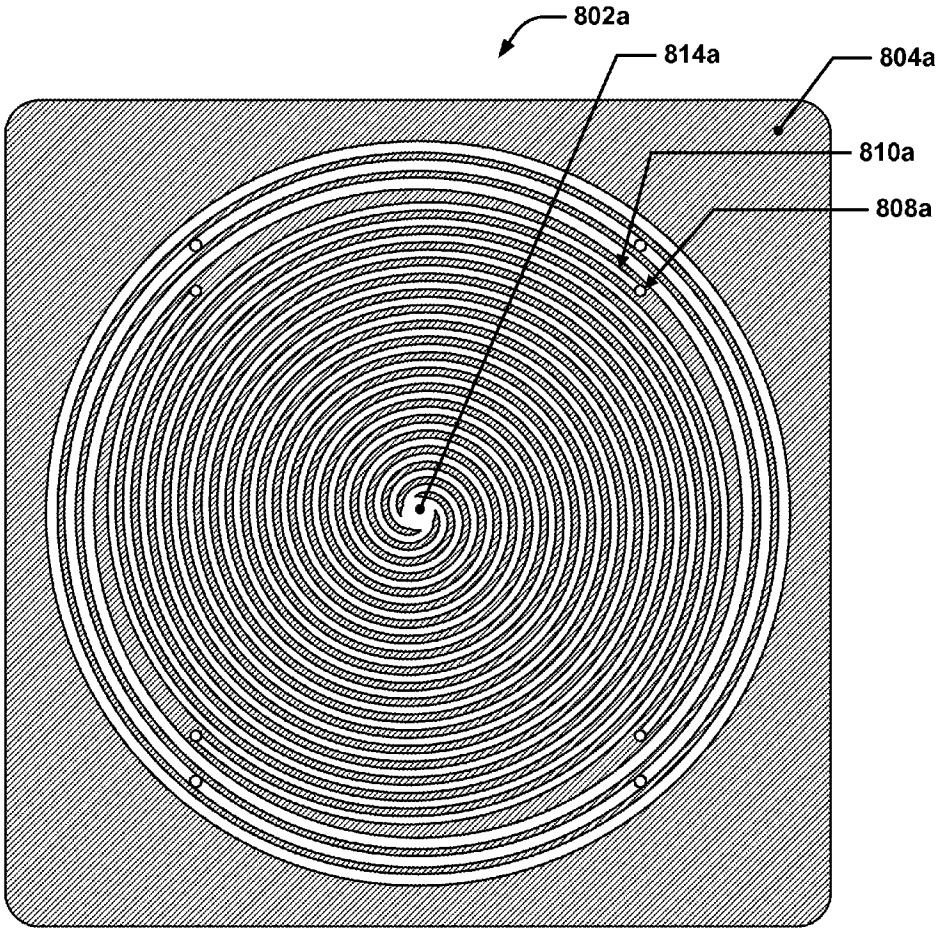
FIG. 8A is a top view of an example vaporizer plate with spiral first channels.

FIG. 8A is a top view of an example vaporizer plate with spiral first channels. The vaporizer plate 802*a* includes a first side 804*a*, multiple first holes (with first hole 808*a* annotated), multiple first channels (with first channel 810*a* annotated), and a first inlet area 814*a*. A second side of the vaporizer plate 802*a* is not shown in FIG. 8A. The second side may include multiple second channels and other features. The multiple second channels may be arranged in a spiral pattern, or may be arranged in other geometries.

The first channels of the vaporizer plate 802*a* are arranged in a spiral pattern. The spiral pattern is one of many possible alternative first channel configurations. The spiral pattern first channels may allow for a greater effective length for the first channels, which may greatly increase the residence time over the radial channels discussed above with respect to the vaporizer plate 102. Due to the spiral pattern, however, there may be a corresponding decrease in the number of channels that may be supported in a given area (if the spiral has, for example, a sufficient number of turns). The greater effective length for the radial first channels compared to the length of radial first channels may allow the precursor to be heated for a longer period of time before reaching the first holes, allowing more time for conductive heat transfer into the precursor.

To give some further sense of scale, some specific dimensions associated with one implementation of a spiral-channel vaporizer plate are provided below; these are, of course, merely for example purposes only, and other implementations may have other dimensional values, depending on the specific precursor used as well as other considerations.

For example, the four first channels 810 may be ~1.75 $mm^2$ and may have a channel length of 75 cm (instead of the 10 cm discussed above with respect to the straight radial channels). Under similar flow and temperature conditions as discussed above with respect to the earlier example, such an arrangement may produce complete or near-complete evaporation of a fluid such as water. Of course, some adjustment may be required for other precursors or desired evaporation conditions.

Figure 8B:
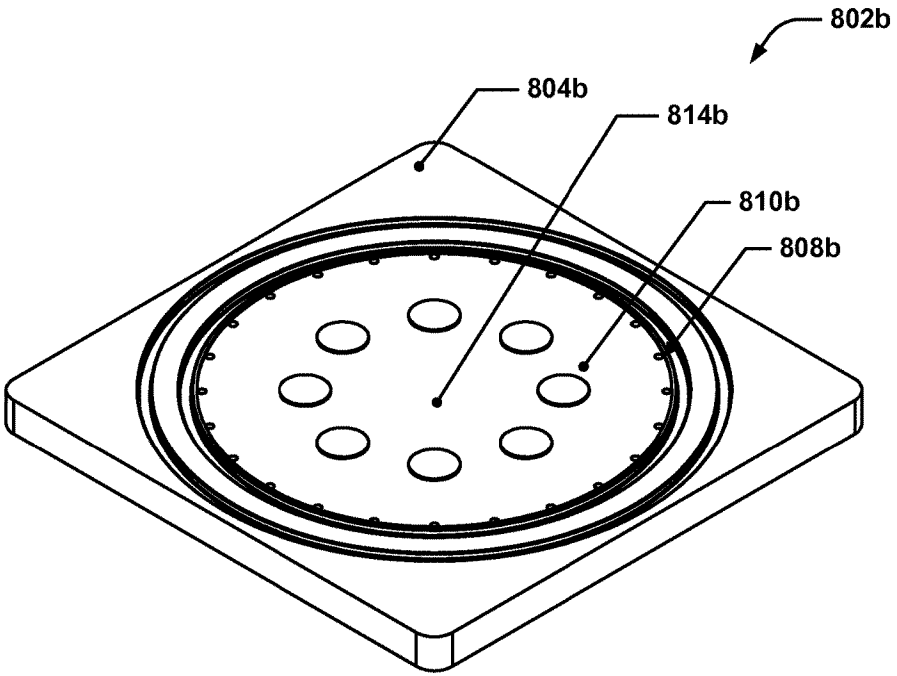
FIG. 8B is an isometric view of an example vaporizer plate with a counterbore first channel.

FIG. 8B is an isometric view of an example vaporizer plate with a counterbore first channel. The vaporizer plate 802*b* includes a first side 804*b*, multiple first holes 808*b*, a counterbore first channel 810*b*, and a first inlet area 814*b*. A second side of the vaporizer plate 802*b* is not shown in FIG. 8A. The second side may include a second channel similar to the first channel 810*b* or multiple second channels, such as are described earlier in this document, as well as other features.

The counterbore first channel 810*b* is a very wide and flat, but thin first channel. In effect, this single channel replaces the multitude of first channels discussed with respect to the earlier examples discussed above. The first channel 810*b*, as pictured, may have large counterbore that has an outer diameter that is approximately as large as the maximum distance between the outermost perimeters of the first holes 808*b* (thus, the first holes 808*b* may be located generally along the perimeter of the counterbored area). In such implementations, the inlet area 814*b* and the first channel 810*b* may not be clearly delineated from one another, e.g., the inlet area 814*b* may simply be a sub-portion of the first channel 810*b* that is located where the precursor is flowed into the first channel 810*b*. The precursor would then flow radially outward in all directions towards the first holes 808*b*. Such radial flow may be interrupted by, for example, raised boss features such as the eight raised bosses located approximately mid-diameter in the counterbored area. Such raised bosses may act as heat conduction conduits to transfer heat between the heating platens used and the vaporizer plate 802*b*; this may help make the temperature within the vaporizer plate 802*b* be more radially uniform. The wide and flat, but thin geometry of the counterbore first channel 810*b* may allow for a much lower flow pressure loss as compared with multiple, long, thin channels. The counterbore geometry may also allow for a vaporizer plate that may be more easily manufactured than vaporizer plates having a multitude of small, thin channels.

FIGS. 8A and 8B are examples of two alternative first channel geometries. The alternative geometries may also be used by other channels such as the second channel, third channel, fourth channel, etc. The geometry of the channels may be varied depending on the precursor, the flow rate, and the amount of heating required. Other geometries for the channels may also be used with other implementations of the vaporizer.

Figure 9:
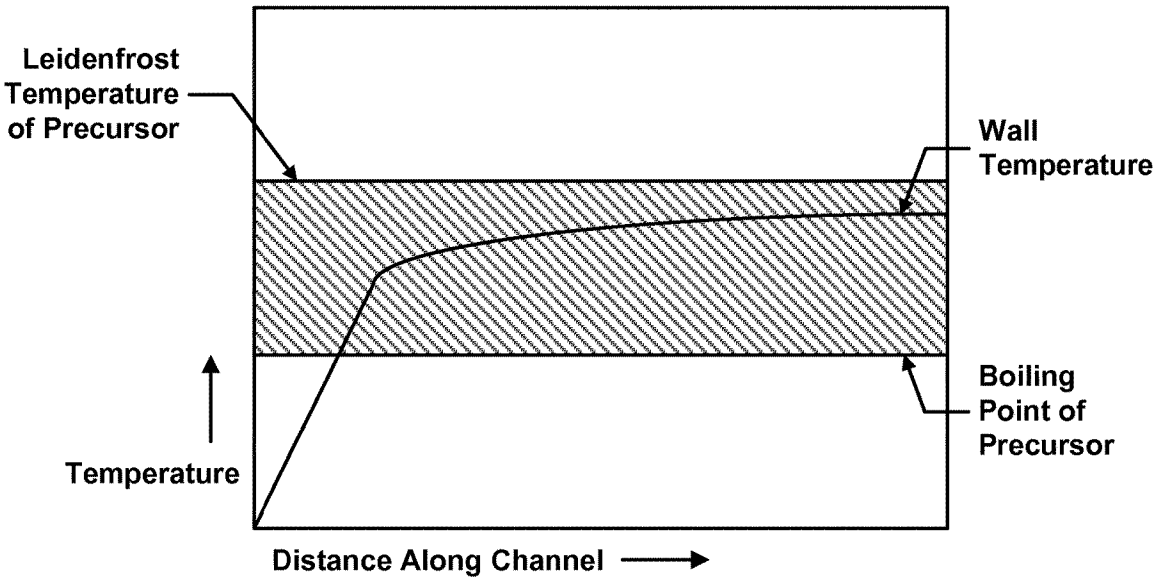
FIG. 9 is an example temperature plot of a precursor that travels along an example first channel.

FIG. 9 is an example temperature plot of a precursor that travels along an example first channel during operation of an example vaporizer. The x-axis of FIG. 9 corresponds to distance along the first channel while the y-axis corresponds to the temperature of the precursor. The first channel of the implementation described in FIG. 9 may be heated and the heated first channel increases the temperature of the precursor as the precursor travels along the first channel. The first channel may be heated to a temperature above the boiling point of the precursor, but below the Leidenfrost temperature of the precursor. The left-most point of the graph is where the precursor enters. The precursor may initially enter the first channel at a temperature below the boiling point of the precursor. As the precursor moves along the length of the first channel, the precursor may approach an equilibrium temperature that is above the boiling point of the precursor, but below the Leidenfrost temperature of the precursor. At least a portion of the precursor flowing through the example first channel of FIG. 9 may be vaporized since the first channel is heated to a temperature above the boiling point of the precursor.

The temperature range between the boiling point and the Leidenfrost temperature is shown as a cross-hatched region in FIG. 9. If the first channel is heated to a temperature above the Leidenfrost temperature, the precursor may be subject to the Leidenfrost effect. As discussed earlier, the Leidenfrost effect occurs when a liquid in contact with a heated body produces an insulating layer of vapor that is then trapped between the liquid and the heated body, thus reducing the amount of heat transfer to the liquid and slowing the evaporation rate as compared with sub-Leidenfrost temperatures. The Leidenfrost effect prolongs the time required to boil a liquid and may be an obstacle to complete vaporization of the precursor. Having a first channel heated to a temperature above the boiling point, but below the Leidenfrost temperature of the precursor, may allow the first channel to increase the amount of precursor vaporized within a given vaporizer stage compared to various conventional commercial off-the-shelf vaporizers.

Figure 10:
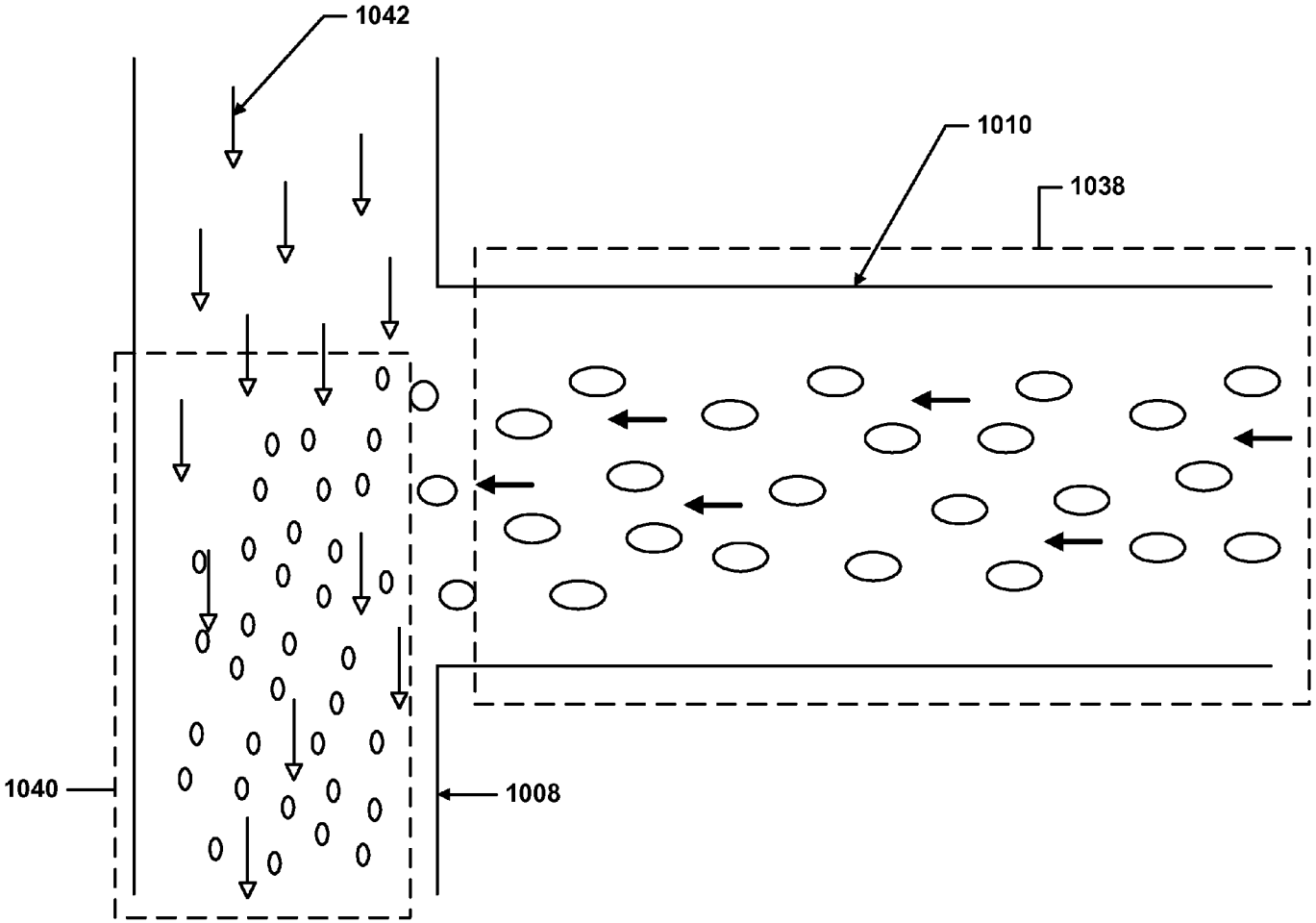
FIG. 10 is a graphical representation of a hypothetical precursor traveling through an example vaporizer's first channel and first hole.

FIG. 10 is an example graphical representation of precursor droplets traveling through an example vaporizer's first channel and first hole. FIG. 10 shows a first hole 1008, a first channel 1010, a group of precursor droplets in region 1038, and a group of precursor droplets post-shearing in region 1040.

In FIG. 10, the group of precursor droplets in region 1038 travels from the right side of the first channel 1010 toward the left side. The first channel 1010 may be heated in the implementation shown in FIG. 10 and a portion of the precursor droplets may be vaporized before reaching the first hole 1008. FIG. 10 does not highlight vaporized precursor, even if a portion of the precursor has been vaporized.

Carrier gas may be introduced to the precursor between the region 1038 and the region 1040 to shear the precursor droplets to a smaller size. After carrier gas has been introduced and has sheared the precursor droplets, the precursor droplets may be smaller in size, as shown by comparing the precursor droplet sizes between region 1038 and region 1040. Smaller precursor droplets may allow for easier vaporization of the precursor. In certain implementations, after the precursor droplets have been sheared to a smaller size by the carrier gas, the precursor may flow through additional heated channels. Such heated channels may be heated to a much higher temperature compared to the temperature of the first channel since smaller droplets have lower surface tension and are thus more resistant to the Leidenfrost effect. The smaller droplet sizes of the precursor may allow for the vaporization of a greater volume of the precursor. Also, in other implementations, the carrier gas may increase the flow rate of the precursor after the carrier gas has been injected.

The equipment described herein may be connected with various other pieces of equipment, e.g., a semiconductor process chamber, in a semiconductor processing tool. Typically, a vaporizer such as that described herein may be connected with a controller, which may be part of the vaporizer or a separate component in communicative contact with various elements of the vaporizer such as, for example, the heating elements discussed above and/or flow controllers or valves for controlling precursor flow, carrier gas flow, purge flow, and/or vacuum application. Such a controller may include one or more processors and a memory that stores instructions for controlling the vaporizer, including the heating elements and potentially other vaporizer-related equipment (such as flow controllers and/or valves) to provide a desired degree of vaporization of a precursor for a given semiconductor process. The instructions may include, for example, instructions to control the heating elements to maintain a desired wall temperature of the first channels and/or the second channels (such temperatures may be monitored through the use of thermocouples that may be inserted into the vaporizer plate or the heating platens, or other temperature sensors that may be used to obtain feedback regarding the estimated wall temperature of the channels), to control the velocity at which to flow the precursor and/or carrier gas, and to control any additional heating elements such as, for example, any couple heater elements and any third or fourth heating elements. As discussed above, the controller may typically include one or more memory devices and one or more processors configured to execute the instructions such that the apparatus will perform a method in accordance with the present disclosure. Machine-readable media containing instructions for controlling process operations in accordance with the present disclosure may be coupled to the system controller.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

It will also be understood that unless features in any of the particular described implementations are expressly identified as incompatible with one another or the surrounding context implies that they are mutually exclusive and not readily combinable in a complementary and/or supportive sense, the totality of this disclosure contemplates and envisions that specific features of those complementary implementations can be selectively combined to provide one or more comprehensive, but slightly different, technical solutions. It will therefore be further appreciated that the above description has been given by way of example only and that modifications in detail may be made within the scope of the disclosure.

What is claimed is:

1. An apparatus comprising:

a first vaporizer plate that is nominally planar, the first vaporizer plate including:
- a first side,
- a second side that is opposite the first side, and
- a plurality of first holes that extend through the first vaporizer plate;
- a plurality of first radial spoke channels bounded at least in part by the first side;
- a plurality of second radial spoke channels bounded at least in part by the second side;
- a first inlet area bounded at least in part by the first side; and
- a first outlet area bounded at least in part by the second side, wherein:
  - the plurality of first holes are arranged in a radial pattern around the first inlet area and around the first outlet area, and are offset from the first inlet area and the first outlet area in a direction parallel to the first side,
  - a majority of the first vaporizer plate is interposed between the first inlet area and first outlet area,
  - each first radial spoke channel extends outward from the first inlet area to a corresponding first hole such that each of the first radial spoke channels fluidically connects the first inlet area to one of the first holes,
  - each second radial spoke channel extends outward from the first outlet area to a corresponding the first hole such that each of the second radial spoke channels fluidically connects the first outlet area to one of the first holes, and
  - each first hole fluidically connects one first radial spoke channel with one second radial spoke channel.

2. The apparatus of claim 1, further comprising a first heating assembly that includes:

a first heating platen that is in thermally-conductive contact with the first side of the first vaporizer plate, and a first heating element configured to heat the first heating platen.

3. The apparatus of claim 2, wherein the first heating element is a heating plate in thermally-conductive contact with the first heating platen.

4. The apparatus of claim 2, wherein:

the first heating platen further includes a platen inlet hole, and the platen inlet hole is fluidically connected with the first inlet area.

5. The apparatus of claim 2, further comprising a second heating assembly that includes:

a second heating platen that is in thermally-conductive contact with the second side of the first vaporizer plate, and a second heating element configured to heat the second heating platen, wherein the first vaporizer plate is interposed between the first heating platen and the second heating platen.

6. The apparatus of claim 5, wherein:

the second heating platen further includes a platen outlet hole; and the platen outlet hole is fluidically connected with the first outlet area.

7. The apparatus of claim 1, wherein the first vaporizer plate is an assembly that includes a heating element between the first side and the second side.

8. The apparatus of claim 1, further comprising one or more carrier gas injector flow channels, wherein:

each of the carrier gas injector flow channels includes a carrier gas injector flow channel first end and a carrier gas injector flow channel second end;

each of the carrier gas injector flow channels is configured to flow a carrier gas; and each of the carrier gas injector flow channel second ends terminates into one of the first radial spoke channels, one of the second radial spoke channels, or one of the first holes.

9. The apparatus of claim 8, further comprising a carrier gas injector, the carrier gas injector configured to inject carrier gas into the one or more carrier gas injector flow channels.

10. The apparatus of claim 1, further comprising:

one or more gas injector flow channels, each gas injector flow channel configured to flow carrier gas into one of the first holes in a direction having a component normal to the first side.

11. The apparatus of claim 10, further comprising:

a gas plenum; and a gas inlet, wherein:

the gas plenum fluidically connects the gas inlet with the one or more gas injector flow channels, and the gas inlet is configured to be fluidically connected with a gas supply.

12. The apparatus of claim 1, wherein each of the one or more first channels has a length to a major cross-sectional width of at least 10:1.

13. The apparatus of claim 12, wherein each of the one or more second channels has a length to a major cross-sectional width of at least 10:1.

14. The apparatus of claim 1, wherein:

the length of each of the first radial spoke channels are equal; and the length of each of the second radial spoke channels are equal.

15. The apparatus of claim 1, further comprising:

a second vaporizer plate that is nominally planar, the second vaporizer plate including:

a third side, a fourth side that is opposite the third side, and a plurality of second holes that extend through the second vaporizer plate;

a plurality of third channels bounded at least in part by the third side;

a plurality of fourth channels bounded at least in part by the fourth side;

a second inlet area that is bounded at least in part by the third side and that is fluidically connected to the first outlet area;

a second outlet area bounded at least in part by the second side, wherein:

the plurality of second holes are arranged in a radial pattern around the second inlet area and around the second outlet area, and are offset from the second inlet area and the second outlet area in a direction parallel to the third side, a majority of the second vaporizer plate is interposed between the second inlet area and second outlet area, each third radial spoke channel extends outward from the second inlet area to a corresponding second hole such that such that each of the third radial spoke channels fluidically connects the second inlet area to one of the second holes, each fourth radial spoke channel extends outward from the second outlet area to a corresponding second hole such that each of the fourth radial spoke channels fluidically connects the second outlet area to one of the second holes, and each second hole fluidically connects one third radial spoke channel with one fourth radial spoke channel.

16. The apparatus of claim 15, further comprising a couple, the couple fluidly connecting the first outlet area with the second inlet area.

17. The apparatus of claim 16, wherein the couple further comprises a couple heater element thermally connected to the couple and configured to deliver heat to gas, fluid, or mixtures thereof that flow through the couple.

18. The apparatus of claim 1, wherein the apparatus includes between 12 and 36 first radial spoke channels.

* * * * *